US012414666B2

(12) United States Patent
Xie et al.

(10) Patent No.: US 12,414,666 B2
(45) Date of Patent: Sep. 16, 2025

(54) CLEANING DEVICE WITH FLUID TANK EMPTY DETECTION

(71) Applicant: SharkNinja Operating LLC, Needham, MA (US)

(72) Inventors: Fai Xie, Jiangsu (CN); Shady Wei, Guangxi (CN); Teddy Li, Jiangsu (CN); Kevin Richard Kennedy, Quincy, MA (US); Bob Yin, Jiangsu (CN)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 18/455,259

(22) Filed: Aug. 24, 2023

(65) Prior Publication Data

US 2025/0040777 A1 Feb. 6, 2025

Related U.S. Application Data

(63) Continuation of application No. PCT/CN2023/110777, filed on Aug. 2, 2023.

(51) Int. Cl.
*A47L 11/40* (2006.01)
*F04B 23/02* (2006.01)

(52) U.S. Cl.
CPC ..... *A47L 11/4011* (2013.01); *A47L 11/4083* (2013.01); *A47L 11/4088* (2013.01); *F04B 23/02* (2013.01); *F04B 2203/02* (2013.01)

(58) Field of Classification Search
CPC ..... A47L 11/4011; A47L 11/4083; A47L 11/4088; A47L 11/4008; F04B 23/02–06;
(Continued)

(56) References Cited

U.S. PATENT DOCUMENTS 5,743,598 A * 4/1998 Toda ..... B60T 8/4291 303/122.12
6,126,249 A * 10/2000 Kohl ..... B60T 8/404 303/DIG. 11
(Continued)

FOREIGN PATENT DOCUMENTS

CN 110537878 A 12/2019
CN 110649853 B 1/2021
(Continued)

OTHER PUBLICATIONS

International Search Report and Written Opinion for PCT Patent Application No. PCT/CN2023/110777 mailed Nov. 7, 2023.
(Continued)

*Primary Examiner* — Thomas Fink
(74) *Attorney, Agent, or Firm* — Mintz, Levin, Cohn, Ferris, Glovsky and Popeo, P.C. US

(57) ABSTRACT

Various cleaning devices with fluid tank empty detection and methods related thereto are provided. In general, a cleaning device can be configured to determine whether a fluid container is empty using an electromotive force (EMF) at a fluid pump configured to pump fluid from the fluid container. When the fluid container becomes empty, fluid cannot be supplied from the cleaning device to a surface until more fluid is added to the fluid container. Thus, by determining whether the fluid container is empty, a user of the cleaning device may be made aware when the fluid container becomes empty and needs refilling (or replacement).

19 Claims, 18 Drawing Sheets

(58) Field of Classification Search
CPC ..... F04B 2203/02; F04B 49/00; F04D 13/16; F04C 2270/48
See application file for complete search history.

(56) References Cited

U.S. PATENT DOCUMENTS

| | | | | |
|---|---|---|---|---|
| 8,836,257 | B2 | 9/2014 | Savitz | |
| 9,156,372 | B1 * | 10/2015 | Guglielmo | B63B 34/70 |
| 9,320,404 | B2 | 4/2016 | Gornik et al. | |
| 9,593,685 | B2 | 3/2017 | Marioni | |
| 9,816,221 | B2 | 11/2017 | Harwood et al. | |
| 10,288,072 | B2 | 5/2019 | Arnoldi | |
| 10,837,439 | B2 | 11/2020 | Ubidia | |
| 10,913,648 | B2 | 2/2021 | Ubidia | |
| 2020/0029763 | A1 * | 1/2020 | Song | A47L 11/4088 |
| 2021/0244253 | A1 | 8/2021 | Miller | |
| 2022/0022720 | A1 * | 1/2022 | Moser | A47L 11/4075 |
| 2022/0299354 | A1 | 9/2022 | Cunnah et al. | |
| 2023/0181419 | A1 | 6/2023 | Fister | |

FOREIGN PATENT DOCUMENTS

| | | | |
|---|---|---|---|
| CN | 112515587 | A | 3/2021 |
| CN | 113827144 | A | 12/2021 |
| CN | 114109795 | A | 3/2022 |
| CN | 113440073 | B | 6/2022 |
| CN | 114569009 | A | 6/2022 |
| CN | 114601376 | A | 6/2022 |
| CN | 216815663 | U | 6/2022 |
| CN | 216981815 | U | 7/2022 |
| CN | 218066656 | U | 12/2022 |
| CN | 218563861 | U | 3/2023 |
| CN | 116181666 | A | 5/2023 |
| EP | 2902630 | B1 | 1/2018 |
| FR | 2951267 | A1 | 4/2011 |
| GB | 2599669 | A | 4/2022 |

OTHER PUBLICATIONS

Akin et al., "Sensorless Field Oriented Control of 3-Phase Permanent Magnet Synchronous Motors", C2000 Systems and Applications Team; D3 Engineering, Version 1.0, SPRABY9, Mar. 2011, pp. 1-49.

Hein, Matt, "Demystifying BLDC Motor Commutation: Trap, Sine, & FOC", TI Tech Days, Applications Manager, Brushless-DC Motor Drives, Dec. 2020, 49 pages.

* cited by examiner

802

804

CLEANING DEVICE WITH FLUID TANK EMPTY DETECTION

CROSS REFERENCE TO RELATED APPLICATIONS

The present application is a continuation of International Patent Application No. PCT/CN 2023/110777 entitled "Cleaning Device With Fluid Tank Empty Detection" filed Aug. 2, 2023, which is hereby incorporated by reference in its entirety.

FIELD

The present disclosure generally relates to cleaning devices with fluid tank empty detection.

BACKGROUND

Conventional cleaning devices, such as dry vacuums and wet vacuums, perform cleaning operations using suction to take in waste. Dry vacuums operate through the use of suction and may employ a brushroll or other agitator to assist in freeing the waste from a surface. Wet vacuums operate through the use of suction and an agitator or pad, but they also supply fluid to the to-be-cleaned surface in order to assist in removal of waste. The supply of fluid can occur directly, with fluid being sprayed onto a surface, or indirectly, with fluid being sprayed onto an applicator such as an agitator. Some vacuums are either a dry vacuum or a wet vacuum. Some vacuums are wet dry vacuums able to provide the functionality of a dry vacuum and a wet vacuum.

For wet vacuums and wet dry vacuums, the fluid to be supplied to a surface can be stored on board the device in a fluid container such as a fluid supply tank. The amount of fluid in the fluid container decreases as fluid is supplied to the surface to be cleaned. When the fluid container becomes empty, fluid cannot be supplied from the cleaning device to a surface until more fluid is added to the fluid container. However, a user of the cleaning device may not be aware when the fluid container becomes empty and needs refilling (or replacement) because a user may forget to check the fluid container's fill level before attempting to supply fluid from the cleaning device, the container may be opaque and thus have its fill level obscured from user view; the fluid container may be disposed within another component (e.g., a housing or other component) of the cleaning device and thus have its fill level obscured from user view, or another reason. User experience may thus be degraded by fluid not being available in the fluid container when the user desires to clean using the cleaning device.

Accordingly, there remains a need for improved devices, systems, and methods for cleaning devices.

SUMMARY

In general, systems, devices, and methods for cleaning devices with fluid tank empty detection are provided.

In one aspect, a system is provided that in one embodiment includes a fluid pump of a cleaning device and includes a controller. The fluid pump is configured to pump a fluid from a fluid supply tank for delivery to a surface to be cleaned by the cleaning device. The fluid pump includes a motor configured to drive the pumping of the fluid of and to generate an electromotive force (EMF). The controller is configured to receive from the fluid pump a signal indicative of the EMF and is configured to determine, based on the received signal, whether the fluid supply tank is substantially empty.

The system can have any number of variations. For example, the controller can be configured to, in response to determining that the fluid supply tank is substantially empty, cause a user notification to be provided via the cleaning device indicating that the fluid supply tank is substantially empty.

For another example, the controller receiving the signal can include the controller receiving a plurality of signals from the fluid pump, each of the plurality of signals can be indicative of the EMF generated by the motor during a period of time, and the controller determining whether the fluid supply tank is substantially empty can include the controller comparing the plurality of signals with a predetermined threshold EMF value. Further, the predetermined threshold EMF value can be a preset value that does not change: or the controller can be configured to determine whether the plurality of signals are outside of a predetermined range, if the plurality of signals are not outside of the predetermined range, the predetermined threshold EMF value can remains the same, and if the plurality of signals are outside of the predetermined range, the controller can be configured to change the predetermined threshold EMF value to a new predetermined threshold EMF value. Further, the controller can be configured to calculate the new predetermined threshold EMF value based on the plurality of signals.

For yet another example, the motor can include a rotor and a stator.

For still another example, the system can further include the fluid supply tank.

In another embodiment, a system includes a processor and a memory storing instructions that, when executed by the processor, cause the processor to perform operations including causing a fluid pump of a cleaning device to pump a fluid from a fluid supply tank for delivery to a surface to be cleaned by the cleaning device. The fluid pump includes a motor configured to drive the pumping of the fluid of and to generate an EMF. The operations also include determining, based on generated EMF, whether the fluid supply tank is substantially empty.

The system can vary in any number of ways. For example, the operations can further include, in response to determining that the fluid supply tank is substantially empty, causing a user notification to be provided via the cleaning device indicating that the fluid supply tank is substantially empty.

For another example, determining whether the fluid supply tank is substantially empty can include comparing EMF data received by the processor from the fluid pump with a predetermined threshold EMF value. Further, the predetermined threshold EMF value can be a preset value that does not change: or the operations can further include determining whether the EMF data are outside of a predetermined range, if the EMF data is not outside of the predetermined range, the predetermined threshold EMF value can remain the same, and if the EMF data is outside of the predetermined range, the operations can further include changing the predetermined threshold EMF value to a new predetermined threshold EMF value. Further, the operations can further include calculating the new predetermined threshold EMF value based on the EMF data.

For yet another example, the motor can include a rotor and a stator.

For still another example, the system can further include the fluid supply tank.

In another aspect, a method is provided that in one embodiment includes causing, using a controller, a fluid pump of a cleaning device to pump a fluid from a fluid supply tank for delivery to a surface to be cleaned by the cleaning device. The fluid pump includes a motor configured to drive the pumping of the fluid of and to generate an EMF. The method also includes determining, using the controller and based on generated EMF, whether the fluid supply tank is substantially empty.

The method can have any number of variations. For example, the method can further include, using the controller and in response to determining that the fluid supply tank is substantially empty, causing a user notification to be provided via the cleaning device indicating that the fluid supply tank is substantially empty.

For another example, determining whether the fluid supply tank is substantially empty can include comparing, using the controller, EMF data received by the processor from the fluid pump with a predetermined threshold EMF value. Further, the predetermined threshold EMF value can be a preset value that does not change; or the method can further include determining, using the controller, whether the EMF data are outside of a predetermined range, if the EMF data is not outside of the predetermined range, the predetermined threshold EMF value can remain the same, and if the EMF data is outside of the predetermined range, the method can further include changing, using the controller, the predetermined threshold EMF value to a new predetermined threshold EMF value. Further, the method can further include calculating, using the controller, the new predetermined threshold EMF value based on the EMF data.

For yet another example, the motor can include a rotor and a stator.

BRIEF DESCRIPTION OF DRAWINGS

This disclosure will be more fully understood from the following detailed description taken in conjunction with the accompanying drawings, in which.

DETAILED DESCRIPTION

Figure 1:
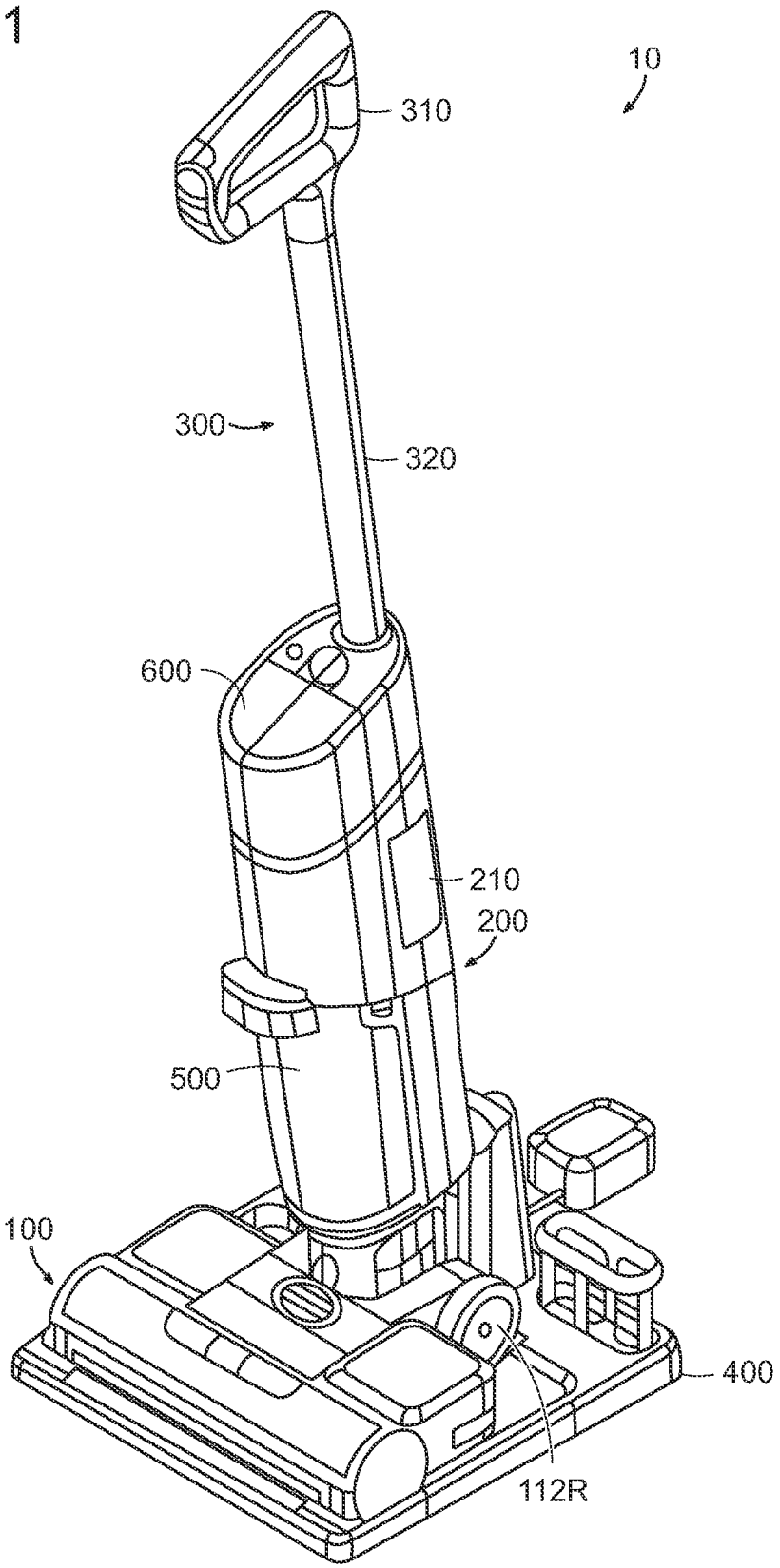
FIG. 1 is a perspective view of one embodiment of a cleaning device.

Certain embodiments will now be described to provide an overall understanding of the principles of the structure, function, manufacture, and use of the devices, systems, and methods disclosed herein. One or more examples of these embodiments are illustrated in the accompanying drawings. Those skilled in the art will understand that the devices, systems, and methods specifically described herein and illustrated in the accompanying drawings are non-limiting embodiments and that the scope of the present invention is defined solely by the claims. The features illustrated or described in connection with one exemplary embodiment may be combined with the features of other embodiments. Such modifications and variations are intended to be included within the scope of the present invention.

Further, in the present disclosure, like-named components of the embodiments generally have similar features, and thus within a particular embodiment each feature of each like-named component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape.

Various cleaning devices with fluid tank empty detection and methods related thereto are provided. In general, a cleaning device can be configured to determine whether a fluid container is empty using characterizing an electromotive force (EMF) at a fluid pump configured to pump fluid from the fluid container. When the fluid container becomes empty, fluid cannot be supplied from the cleaning device to a surface until more fluid is added to the fluid container. Thus, by determining whether the fluid container is empty, a user of the cleaning device may be made aware when the fluid container becomes empty and needs refilling (or replacement). User experience may thus be improved by allowing fluid to be available in the fluid container when the user desires to clean using the cleaning device.

Some traditional cleaning devices can include a sensor, e.g., a photoelectric sensor, configured to detect whether a fluid container is empty. However, such sensors are expensive and add cost to the cleaning device. The fluid tank empty detection described herein does not use a photoelectric sensor or other type of sensor in detecting whether a fluid container is empty and thus avoids cost of such a sensor. Additionally, such sensors are susceptible to damage by being exposed to fluid since the sensors are used in association with a fluid container. Whether or not the fluid container is empty cannot be determined if the sensor is damaged, thereby reducing functionality of the cleaning device and reducing user experience. The fluid tank empty detection described herein does not use a photoelectric sensor or other type of sensor in detecting whether a fluid container is empty and thus avoids reducing functionality of the cleaning device and reducing user experience due to a damaged sensor. Further, the fluid tank empty detection described herein uses existing components of a cleaning device, e.g., a fluid pump and a controller, and therefore does not add any additional components to the cleaning device in order to achieve fluid tank empty detection, which may help maintain a lower cost of the cleaning device, may free real estate for other components, and/or may allow for a smaller cleaning device.

The systems, devices, and methods described herein are not limited to cleaning devices. The systems, devices, and methods described herein can be similarly used with other types of devices having a fluid supply tank configured to be refilled (or replaced).

Various embodiments of cleaning devices are described, for example, in U.S. Pat. No. 11,484,172 entitled "Wet Dry Appliance" issued Nov. 1, 2022, U.S. patent application Ser. No. 17/950,942 entitled "Wet Dry Appliance" filed Sep. 22, 2022, and U.S. patent application Ser. No. 17/653,558 entitled "Low Cost Cleaning Head For Cleaning Devices" filed Mar. 4, 2022, which are hereby incorporated by reference in their entireties.

FIGS. 1-4 illustrate one exemplary embodiment of a cleaning device 10. The illustrated cleaning device 10 includes a head assembly 100, a body assembly 200, a handle assembly 300, and a vacuum assembly (obscured in FIGS. 1-4). The cleaning device 10 is shown disposed atop a charging mat 400, but the cleaning device 10 can be configured to not be usable with a charging mat. The device 10 also includes fluid delivery and fluid recovery assemblies. In this illustrated embodiment, the handle assembly 300 includes a handle 310 and a stem 320, and the body assembly 200 includes a body housing 210 coupled to the stem 320. The head assembly 100 is coupled to the body housing 210 opposite the stem 320. The head assembly 100 includes a head housing 110 and includes small wheels (obscured in FIGS. 1-4) and large wheels 112L, 112R rotatably coupled to the head housing 110 and configured to allow the cleaning device 10 to roll along a surface. The head assembly 100 also includes a brushroll (obscured in FIGS. 1-4) disposed in the head assembly 100 and configured to rotate during operation of the cleaning device 10. The cleaning device 10 in this illustrated embodiment is described as including a brushroll, but the cleaning device 10 can include another type of agitator.

The vacuum assembly is disposed within the head and body assemblies 100, 200 and is capable of taking in fluid, dirt, debris, and other waste through suction and storing it within the cleaning device 10. As in this illustrated embodiment, the vacuum assembly can include a motor and a motor fan. The motor and motor fan can be entirely contained in a motor housing disposed within the body assembly 200. Hosing 230 is coupled to the motor fan and runs through the body assembly 200 to the head assembly 100 to allow the motor to generate a suction force to draw waste into the device 10. Waste taken in by the vacuum assembly through the hosing 230 is deposited into a recovery tank 500 removably disposed within the body assembly 200. In other embodiments, the recovery tank 500 may not be removable.

The cleaning device 10 also include a fluid supply tank 600, also referred to herein as a "fluid container." The fluid supply tank 600 is configured to contain fluid therein that is configured to be supplied from the device 10 to a floor or other area to be cleaned. The fluid contained in the fluid supply tank 600 is clean fluid. The clean fluid can be water, a cleaning solution, or other fluid configured to aid in cleaning the floor or other area to which the fluid is delivered from the device 10. Once delivered from the device 10, the fluid can be mixed with waste (e.g., dirt, dirty fluid, debris, etc.). The cleaning device 10 is configured to draw the waste and fluid mixed therewith into the device 10 with suction generated by the motor and to deposit the drawn-in material in the recovery tank 500.

As previously indicated, the cleaning device 10 is configured to operate in a wet cleaning mode and a dry cleaning mode. The device 10 can operate in only one of the wet and dry cleaning modes at a time or can operate in the wet and dry cleaning modes simultaneously. The cleaning device 10 in this illustrated embodiment is configured operate normally in a dry cleaning mode in which the vacuum assembly is employed to suction in waste, but upon selection of the wet cleaning mode, the cleaning device 10 will also begin to emit fluid to aid in the cleaning process. As discussed further below, the device 10 includes a user interface 302 (see FIG. 2) configured to allow user selection of cleaning mode.

Dry cleaning modes generally include modes related to traditional vacuuming operations, such as vacuuming on hard surfaces or on softer surfaces, such as carpet. Dry cleaning modes rely on suction to take waste into the recovery tank of the cleaning device 10 for convenient disposal. In some dry cleaning modes, the brushroll can rotate to agitate waste on a cleaning surface. The brushroll can loosen the waste while simultaneously directing it toward a suction intake of a cleaning device. In other dry cleaning modes, the brushroll does not rotate (or, in other embodiments, a brushroll is not present), and instead, suction is relied on alone to force waste into the cleaning device 10.

Wet cleaning modes generally include the cleaning device 10 supplying fluid from the fluid supply tank 600 either directly or indirectly to a surface to aid in cleaning. The supplied fluid can act to loosen waste stuck to the surface, and the dirtied fluid can be taken into the cleaning device through suction or other means. In some wet cleaning modes, like some dry cleaning modes described above, the brushroll can further assist in loosening waste off the surface and directing it toward a suction intake. In these wet cleaning modes, the fluid can be supplied directly to the brushroll in order to simultaneously apply the fluid to the surface while agitating the waste found on the surface. In other wet cleaning modes, the fluid can be supplied directly to the surface and the brushroll can agitate the wetted surface. In still other modes, the fluid can be supplied directly to the surface and the brushroll can remain stationary (or, in other embodiments, a brushroll is not present), thereby cleaning the surface with fluid and suction alone.

Figure 5:
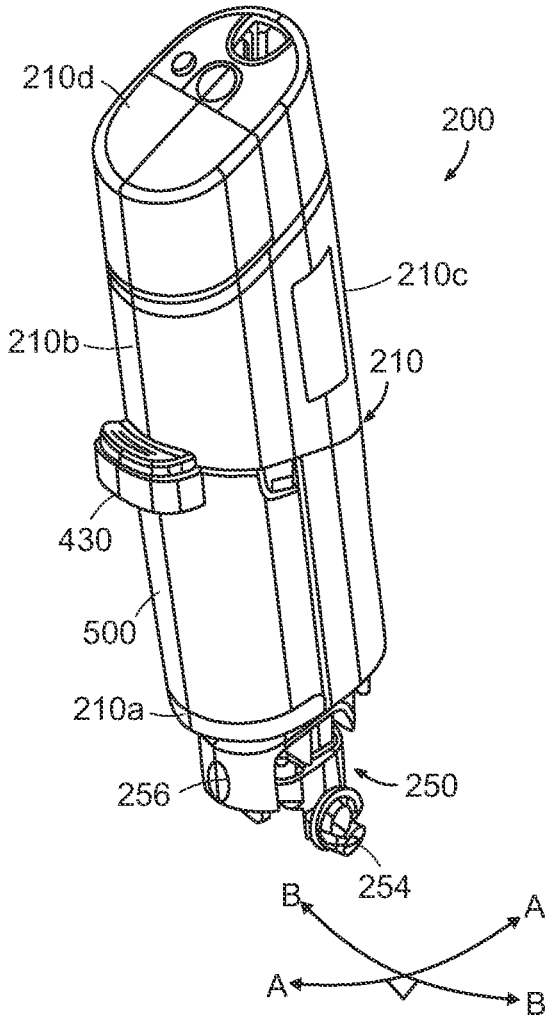
FIG. 5 is a perspective view of a body assembly of the cleaning device of FIG. 1 with one embodiment of a fluid supply tank and one embodiment of a recovery tank removably coupled with the body assembly.
Figure 6:
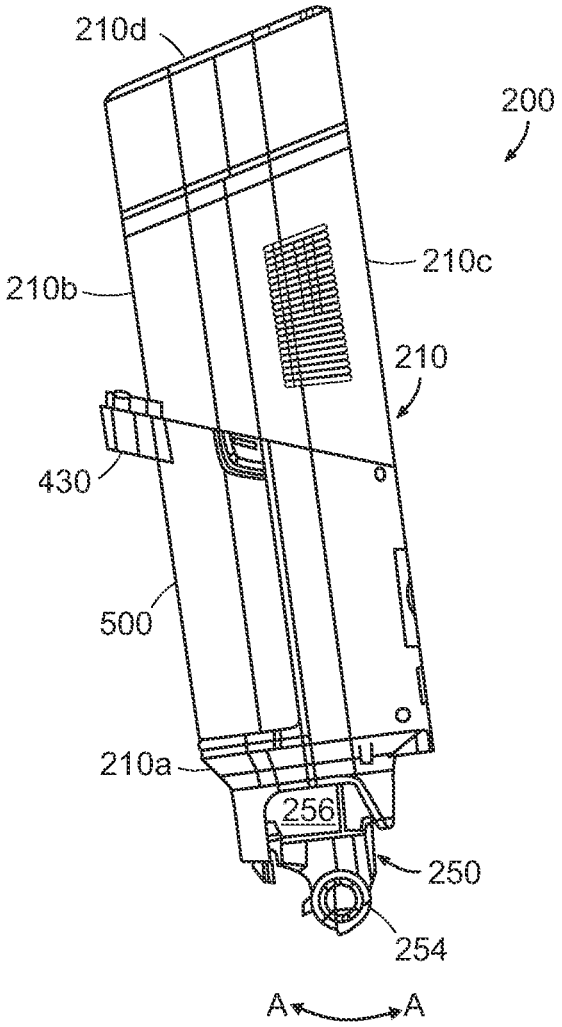
FIG. 6 is a side view of the body assembly, the fluid supply tank, and the recovery tank of FIG. 5.

As shown in FIGS. 5 and 6, the body assembly 200 is configured to be operatively coupled to the head assembly 100 via an articulator 250. The articulator 250 is coupled to the bottom of the body assembly 200 and is configured to at least partially disposed within the head assembly 100. The illustrated articulator 250 is configured to articulate about two degrees of freedom. A first point of articulation 254, allowing for articulation about a first degree of freedom, is mounted within the head assembly 100. The first point of articulation 254 allows for the body assembly 200 to pivot between a forward direction and a backward direction, as indicated by the arrows A-A in FIGS. 5 and 6. A second point of articulation 256, located above the first point of articulation 254, allows for the body assembly 200 to pivot between a left direction and a right direction, as indicated by the arrows B-B in FIG. 5. One or both of the first and second points of articulation 254, 256 can be articulated at a given time. Further, in other embodiments, the body assembly 200 can be configured to articulate in any number of degrees of freedom about any number of points of articulation.

As also shown in FIGS. 5 and 6, the body housing 210 of the body assembly 200 includes a housing base 210*a*, a front side 210*b*, a rear side 210*c* extending upward from the housing base 210*a*, and a top side 210*d*. The top side 210*d* of the body housing 210 is coupled to the handle assembly 300, which extends from the body assembly 200 in a direction opposite the head assembly 100.

Figure 7:
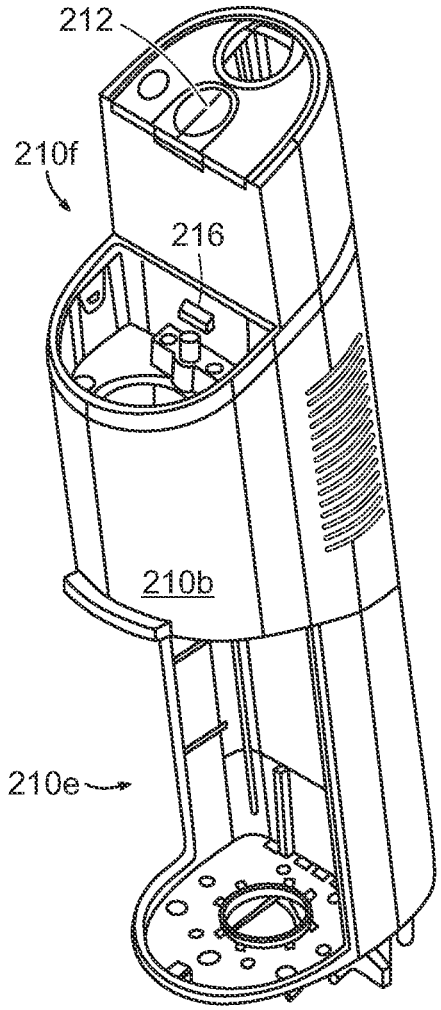
FIG. 7 is a perspective view of the body assembly of FIG. 5 without a fluid supply tank and a recovery tank removably coupled with the body assembly.
Figure 8:
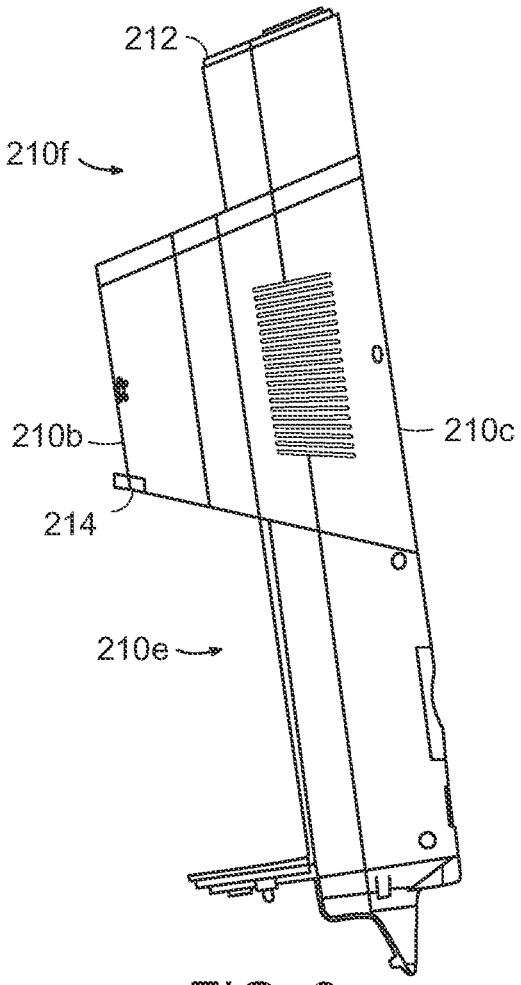
FIG. 8 is a side view of the body assembly of FIG. 7.
Figure 9:
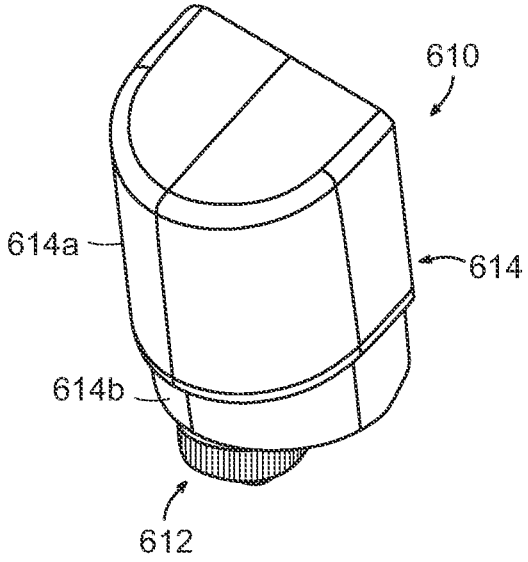
FIG. 9 is a perspective view of the fluid supply tank of FIG. 5.
Figure 10:
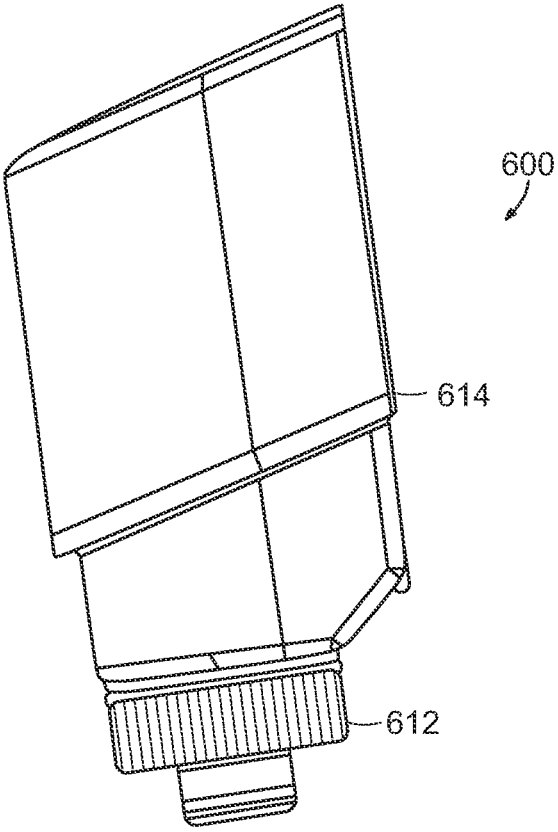
FIG. 10 is a side view of the fluid supply tank of FIG. 9.
Figure 11:
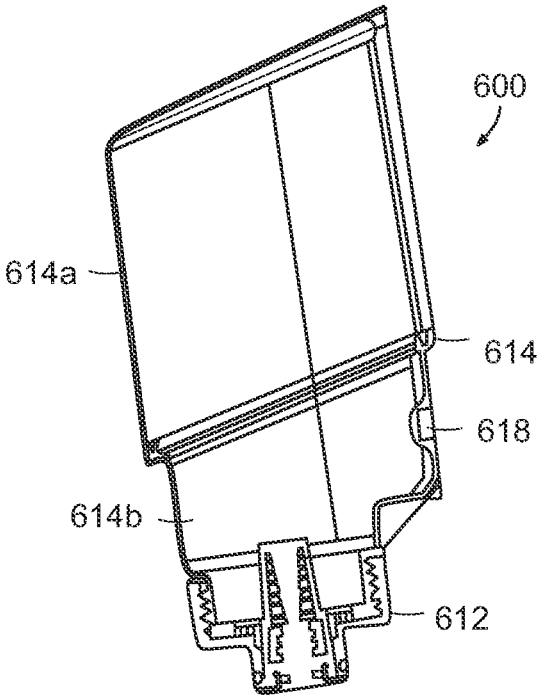
FIG. 11 is a side cross-sectional view of the fluid supply tank of FIG. 9.
Figure 12:
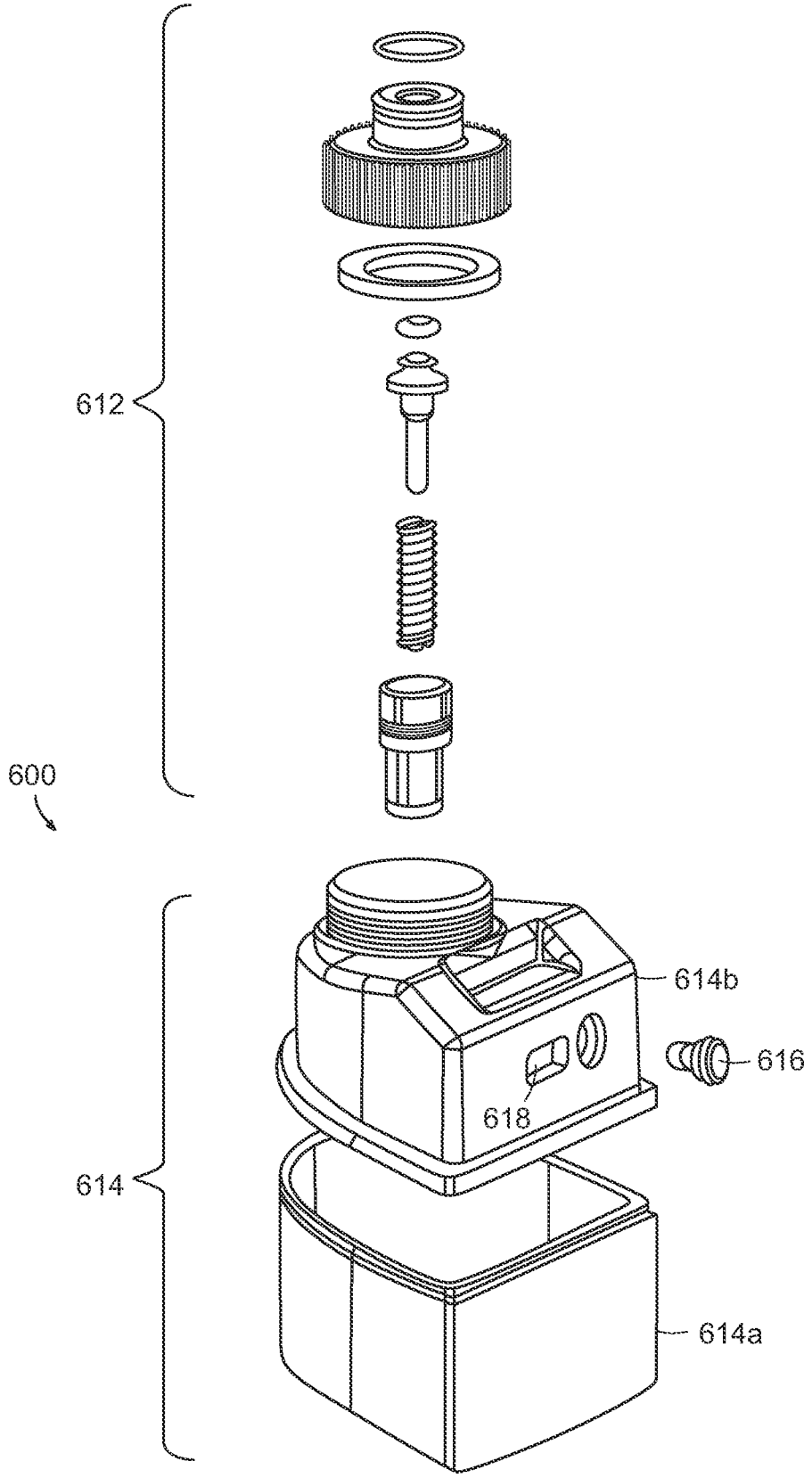
FIG. 12 is an exploded view of the fluid supply tank of FIG. 9.

As shown in FIGS. 7 and 8, the body housing 210 of the body assembly 200 includes first and second cavities 210*e*, 210*f* configured to removably receive components of the cleaning device 10. The first cavity 210*e* is configured to removably receive the recovery tank therein, as shown in FIGS. 5 and 6. The second cavity 210*f* is configured to removably seat the fluid supply tank 600 therein, as shown in FIGS. 5 and 6. FIGS. 7 and 8 show the body assembly 200 with the recovery tank and the fluid supply tank 600 removed from the first and second cavities 210*e*, 210*f*, respectively.

The first cavity 210*e*, located in the front side 210*b* of the body housing 210, is sized to removably receive the recovery tank such that, when retained in the first cavity 210*e*, the recovery tank occupies the entirety of a lower region of the front side 210*b* of the body housing 210. The recovery tank is removable from the body housing 210 after actuation of a latch assembly 430) (see FIGS. 5 and 6 extending outward from an upper extent of the recovery tank. The actuation of the latch assembly 430 releases the recovery tank from engagement with a retaining slot 214 (see FIG. 8) that is located toward the front of the first cavity 210*e*.

The second cavity 210*f* is located in an upper front portion 210*b* of the body housing 210 and occupies a substantial portion of the top side 210*d*. The second cavity 210*gf* is sized to removably receive the fluid supply tank 600. A fluid tank switch 212 (see FIGS. 7 and 8) is disposed in the top side 210*d* of the body housing 210. With the fluid supply tank 600 seated in the second cavity 210*f*, a tank engagement feature 216 (see FIG. 7) of the body assembly 200 extends from the body housing 210 and is engaged with the fluid supply tank 600 to lock the fluid supply tank 600 to the body housing 210. When the fluid tank switch 212 is actuated, the tank engagement feature 216 recedes into the body housing 210, which allows the fluid supply tank 600 to be removed from the second cavity 210*f*.

FIGS. 9-12 illustrate the fluid supply tank 600 as a standalone element. As shown in FIGS. 9-12, the fluid supply tank 600 includes a valve cap 612 removably threaded to a fluid tank 614. The fluid tank 614 is divided into an upper tier 614*a* and a lower tier 614*b*. Each of the tiers 614*a*. 614*b* has a substantially hemi-cylindrical shape in this illustrated embodiment but may have other shapes. The upper tier 614*a* is shaped to conform with the overall form of the body housing 210 and provides an outer limit for the upper front face 210*b* of the body housing 210. The lower tier 614*b* is smaller than the upper tier 614*a* in this illustrated embodiment and is configured to be received internally within the body housing 210. The fluid tank 614 defines a hollow interior, which receives the fluid to be supplied by the cleaning device 10 during a wet cleaning operation.

The valve cap 612 of the fluid supply tank 600 permits one-way flow of fluid therethrough from the hollow interior of the fluid tank 614 to externally thereof. The valve cap 612 is configured to be received in the second cavity 210*f* of the body housing 210 in a complementary recess. When the valve cap 612 is properly seated in the second cavity 210*f*, fluid is able to flow therethrough. When the valve cap 612 is not properly seated in the second cavity 210*f*, the valve cap 612 acts to seal the fluid within the fluid supply tank 600.

The valve cap 612 of the fluid supply tank 600 is removably coupled to the lower tier 614*a* via a threaded connection, although other connection types are possible such as a hinged lid, etc. When the fluid supply tank 600 is not removably coupled with the body housing 210, the valve cap 612 is accessible to a user. The valve cap 612 is configured to be removed from a remainder of the fluid supply tank 600, e.g., by being unscrewed by hand, to allow fluid to be added into the hollow interior of the fluid supply tank 600, e.g., by being poured therein through an opening uncovered by removal of the valve cap 612, and/or for fluid to be removed from the hollow interior of the fluid supply tank 600, e.g., by being poured out of the opening uncovered by removal of the valve cap 612.

The lower tier 614*b* includes a bleeder valve 616 and a retention depression 618. As the fluid tank 614 empties of fluid, the bleeder valve 616 is configured to allow for an equalization of pressure in the hollow interior to facilitate a constant supply of fluid to the cleaning device 10, without creating a vacuum within the hollow interior. The retention depression 618 in this illustrated embodiment is a depression formed in the lower tier 614*b* which is shaped to receive the tank engagement feature 216 of the body assembly 200 although other configurations are possible for a retention feature configured to engage the tank engagement feature 216. As explained above, actuation of the fluid tank switch 212 is configured to allow for the fluid supply tank 600 to be removed from the second cavity 210*f*. More specifically, actuation of the fluid tank switch 212 is configured to retract the tank engagement feature 216 into the body housing 210 so that it no longer engages the retention depression 618.

Figure 13:
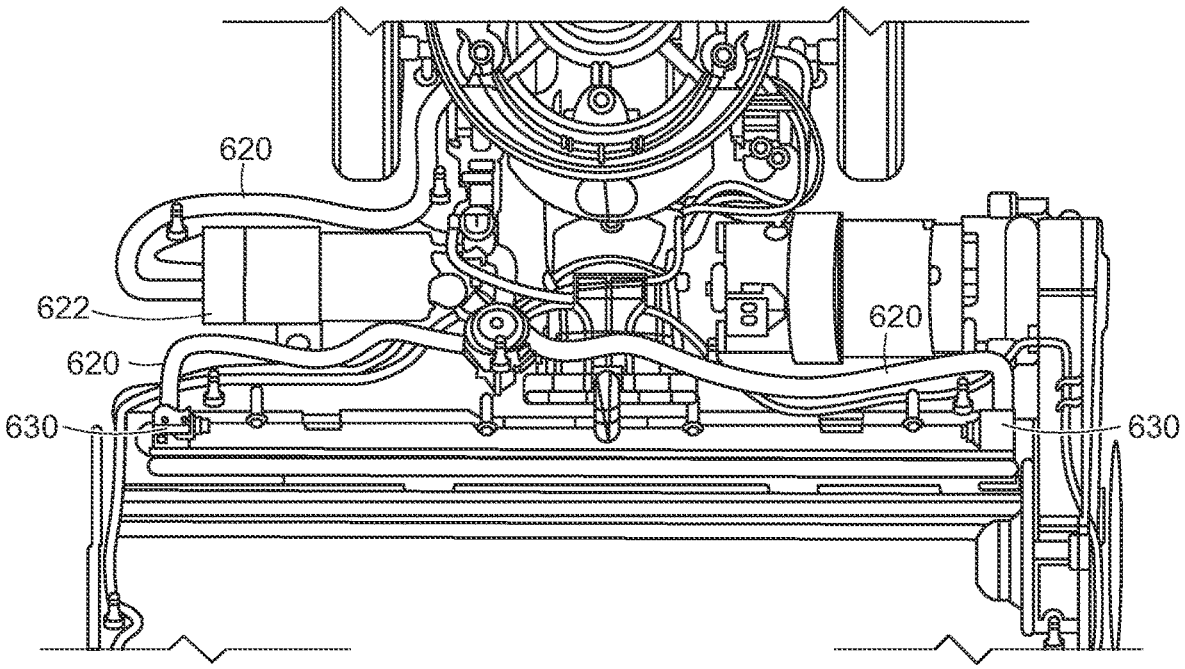
FIG. 13 is a top view of a head assembly of the cleaning device of FIG. 1, the head assembly having no upper housing and showing components used in wet vacuum modes.

FIG. 13 illustrates various components, including tubing 620, a fluid pump 622 (also shown in FIG. 18), and fluid application face 624, and spray nozzles 630, configured to facilitate delivery of fluid from the fluid supply tank 600 to a surface for cleaning. The fluid pump 622 is configured to pump fluid from the fluid supply tank 600 through the cleaning device 10 by providing a force that draws fluid out of the fluid supply tank 600. The fluid supply tank 600, when removably coupled with the body assembly 200, is in fluid communication with the spray nozzles 630 by way of the fluid pump 622 and the tubing 620. When fluid leaves the fluid supply tank 600, e.g., under a pumping force provided by the pump 622, the fluid is transported through the cleaning device 10 in the tubing 620. The tubing 620 connects to the fluid supply tank 610, travels down the body assembly 200, and then travels into the head assembly 100. More particularly, the tubing 620 connects the fluid supply tank 600 to the pump 622 and then leaves the pump 622 before splitting and finally connecting to left and right spray nozzles 630 disposed on the fluid application face 624 of the head assembly 100. In other embodiments, the spray nozzles 630 can be located elsewhere in the head assembly 100 and/or can include a different number of nozzles.

Waste (if any) outside the device 10 mixes with the emitted fluid and creates a slurry which is then suctioned into the cleaning device 10 through a central intake (obscured in the figures) of the head assembly 100. From the central intake, the slurry travels up through the hosing 230 and into the recovery tank 420.

Figure 2:
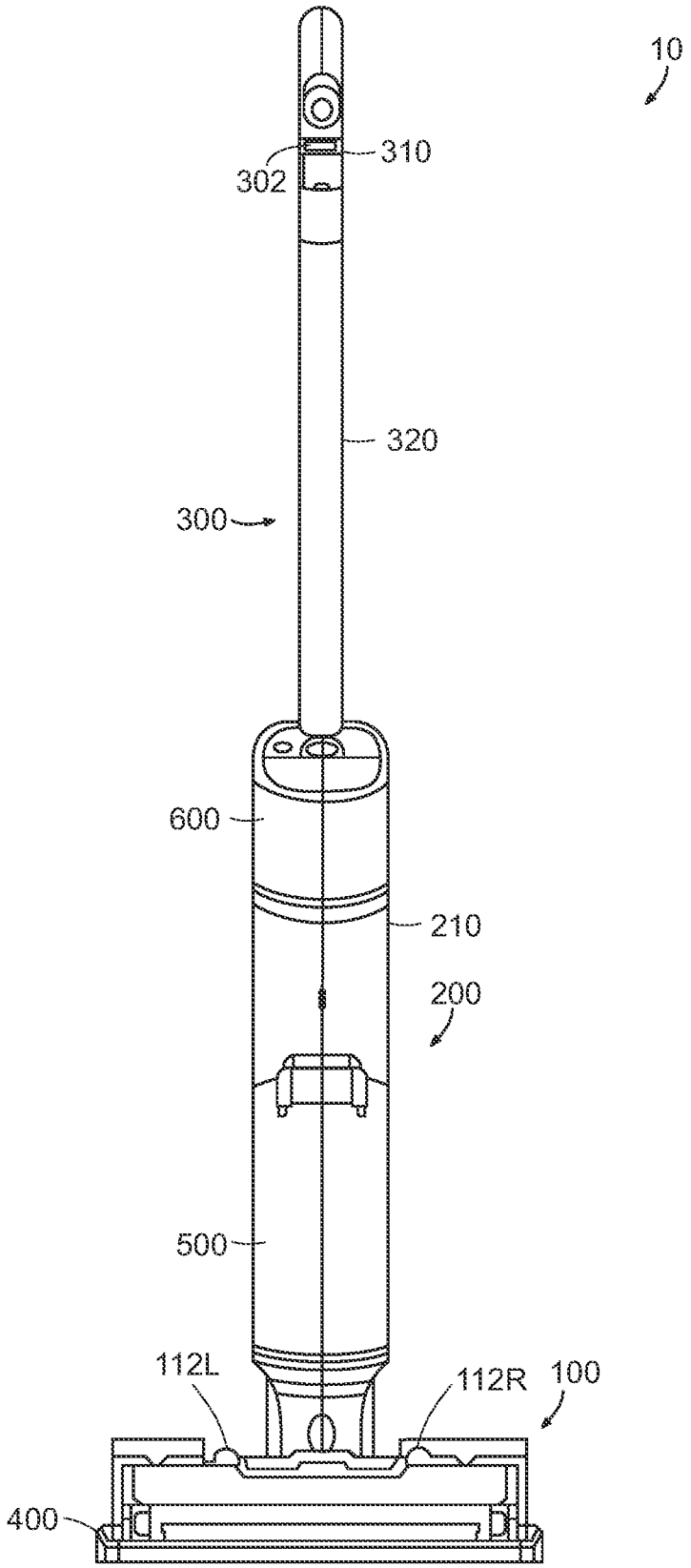
FIG. 2 is a front view of the cleaning device of FIG. 1.
Figure 3:
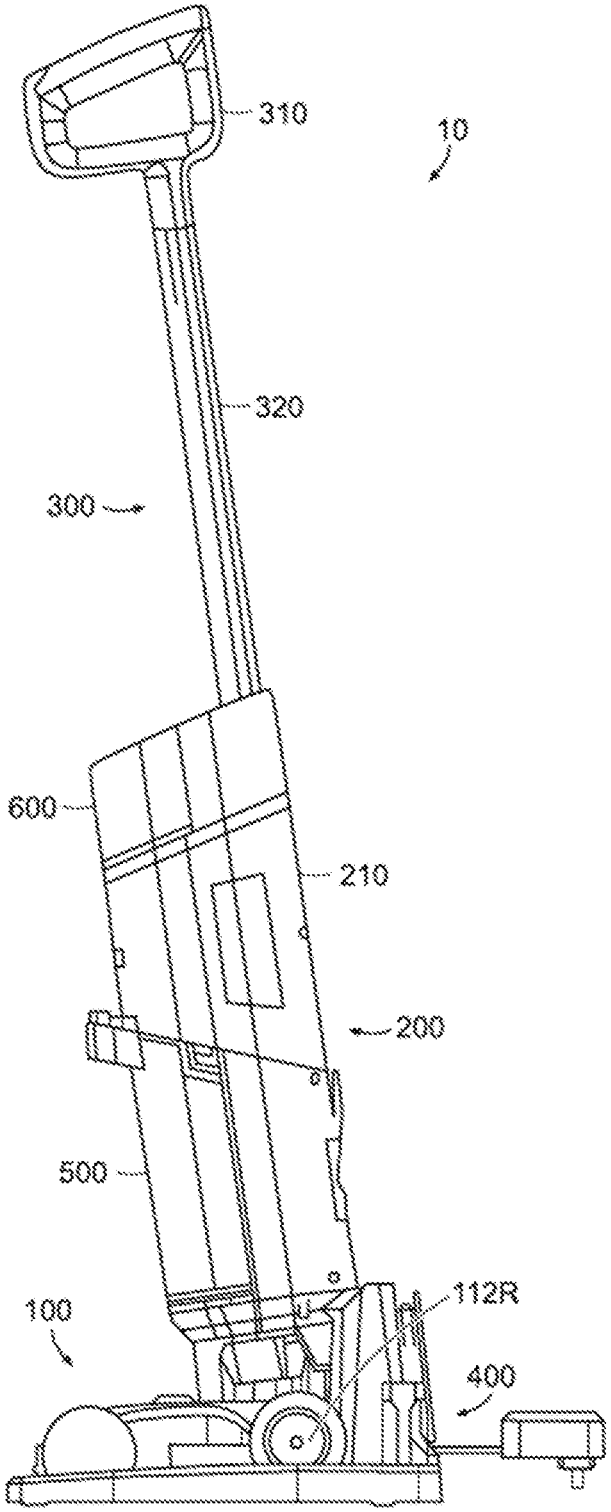
FIG. 3 is a side view of the cleaning device of FIG. 1.
Figure 4:
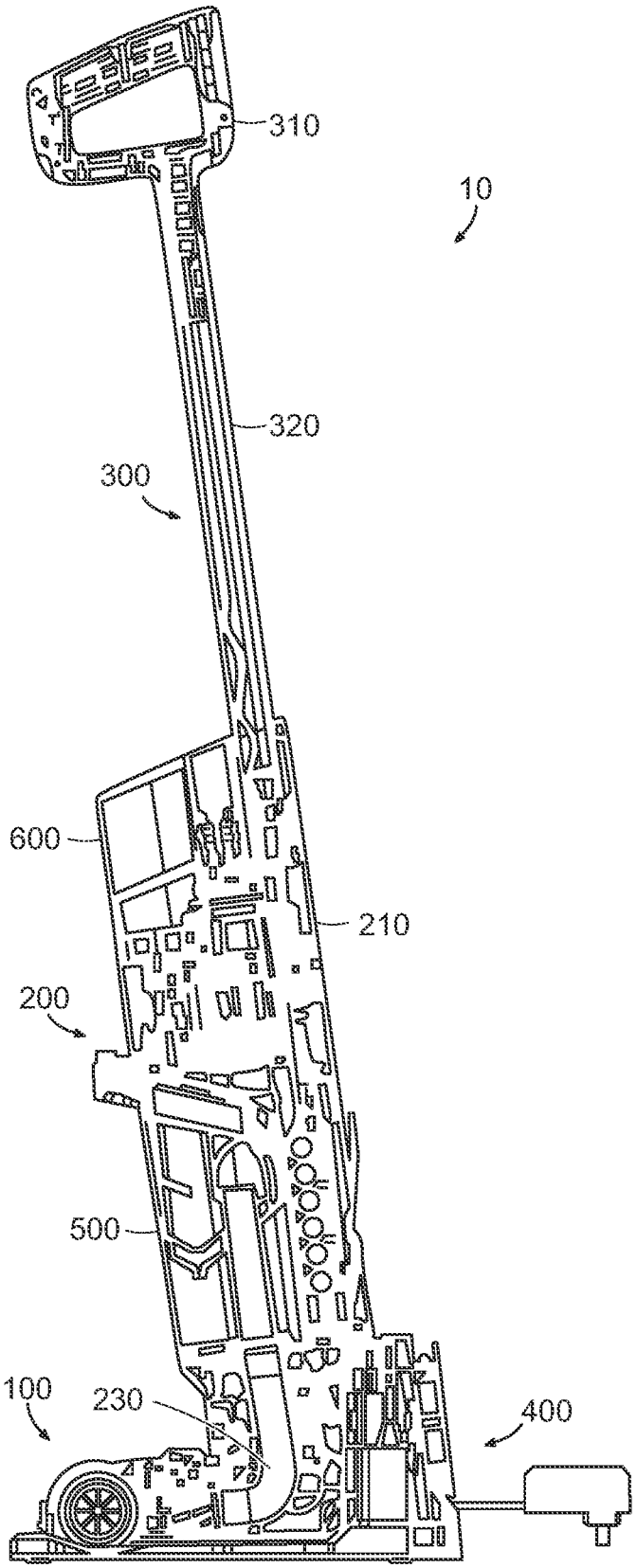
FIG. 4 is a side cross-sectional view of the cleaning device of FIG. 1.

The cleaning device 10 is configured to allow a user to select wet and dry cleaning modes using the user interface 302. The user interface 302 is located at the handle assembly 300 in this illustrated embodiment, as shown in FIGS. 2, 14 and 17 in which the user interface 302 is located on a handle frame 312 of the handle assembly 300, but the user interface 302 can also or instead be located elsewhere, such as at another area of the handle assembly 300, at the head assembly 100, and/or at the body assembly 200.

Figure 14:
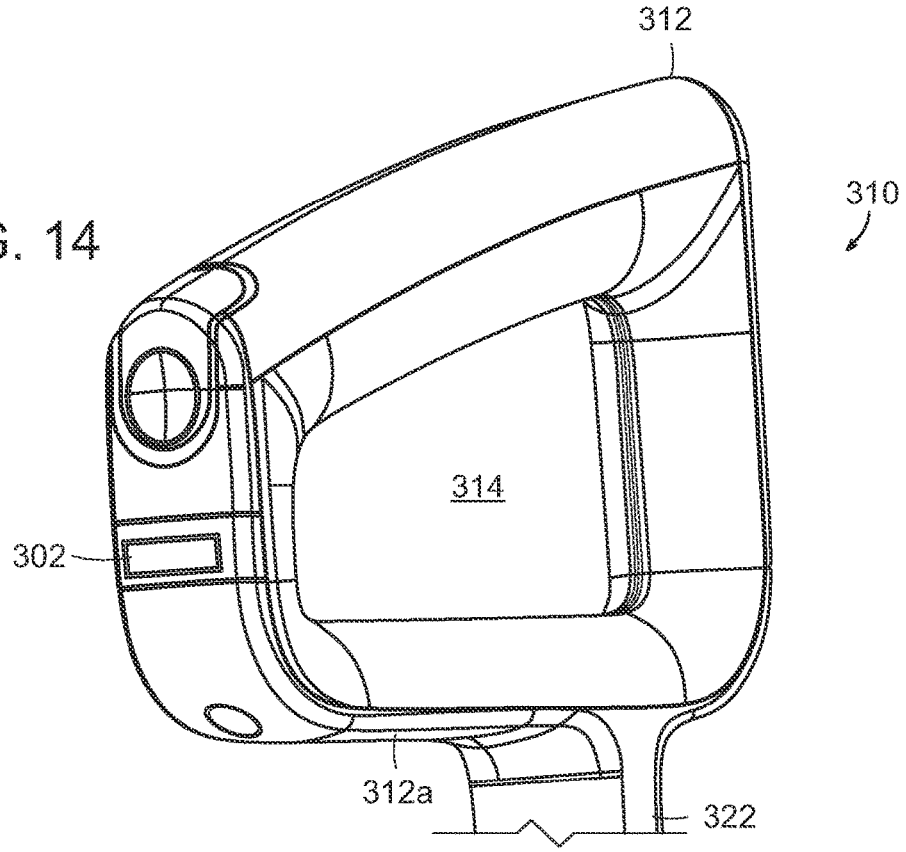
FIG. 14 is a perspective view of a portion of a handle assembly of the cleaning device of FIG. 1.
Figure 15:
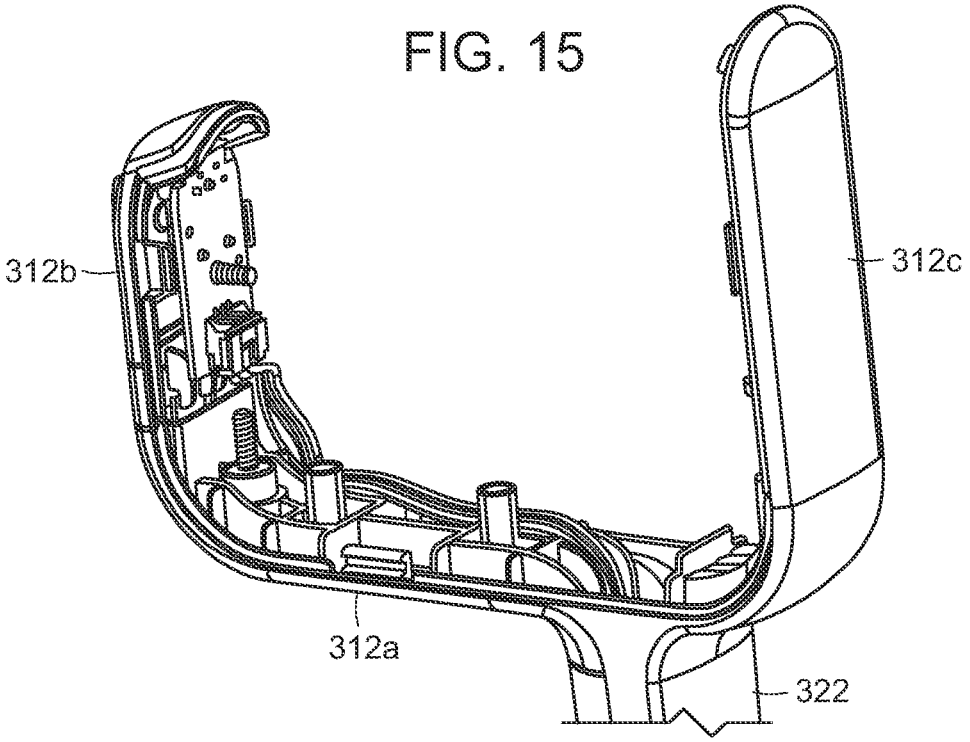
FIG. 15 is a perspective view of a partial portion of the handle assembly of FIG. 14.
Figure 17:
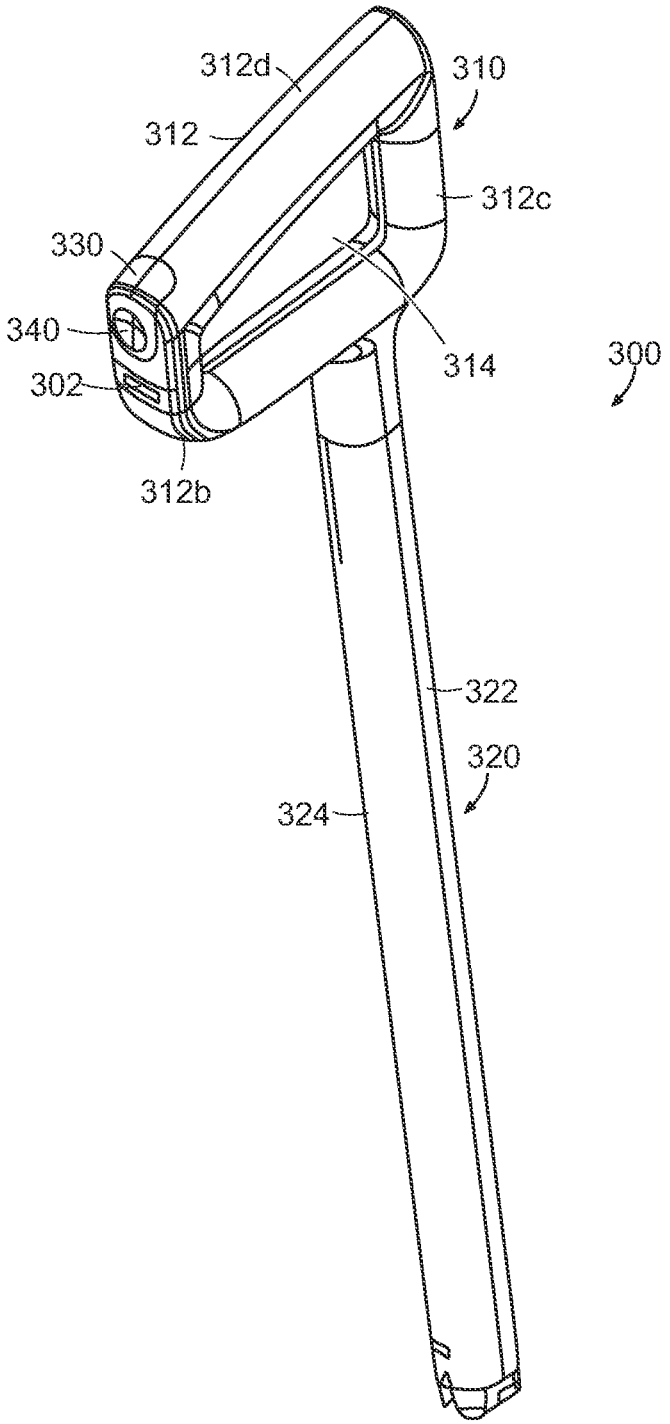
FIG. 17 is a perspective view of the handle assembly of FIG. 14.

As shown in FIGS. 14 and 17, the handle 310 of the handle assembly 300 includes the handle frame 312 and the stem 320. The stem 320 defines and surrounds an interior handle aperture 314. The stem 320) in this illustrated embodiment is substantially linear and has a rear face 322 and a front face 324. A person skilled in the art will appreciate that an element may not be precisely linear but nevertheless be considered substantially linear for any number of reasons, such as manufacturing tolerances and sensitivity of measurement equipment. A person skilled in the art will also appreciate that the handle assembly 300 can have a variety of other configurations.

As shown in FIGS. 14-17, the illustrated handle frame 312 has a bottom section 312*a*, a front section 312*b*, and a back section 312*c* extending upward from the bottom section 312*a* at substantially right angles relative to the bottom section 312*a*. A person skilled in the art will appreciate that an angle may not be precisely a right angle but nevertheless be considered a substantially right angle for any number of reasons, such as manufacturing tolerances and sensitivity of measurement equipment. A top of each of the front section 312*b* and the back section 312*c* are connected by a top section 312*d* of the handle frame 312. The user interface 302 is located on the front section 312*b* of the handle frame 312 in this illustrated embodiment but may be located elsewhere, such as on another section 312*a*, 312*c*, 312*d* of the handle frame 312, on the body assembly 200, and/or on the head assembly 100.

The user interface 302 can have a variety of configurations. In some embodiments, the user interface 302 includes a touchscreen display configured to receive user inputs by touch and to display information thereon for visualization by a user. In some embodiments, the user interface 302, whether including a touchscreen display or not, includes a plurality of input buttons and/or other controls that permit a user to configure operation of the cleaning device 10 by providing various inputs as described herein. For example, in some embodiments, the user interface 302 can include a rotary function dial configured to rotate when turned by a user such that the user can select wet and dry cleaning modes mode in which the cleaning device 10 can operate. For another example, the user interface 302 can include a start/stop button, which, when pressed by a user, causes the controller 350 to start and/or stop various operation of the cleaning device 10 in the selected mode. For yet another example, the user interface 302 can include one or more indicators (e.g., light(s), display(s), speaker(s), etc.) which indicate a status of the cleaning device 10. The one or more indicators can include, for example, any one or more of a fluid supply tank empty indicator that indicates whether the fluid supply tank 600 is empty, a mode indicator that indicates which cleaning mode is selected, a power status indicator that indicates whether the cleaning device 10 is powered on, etc.

The handle assembly 300 also includes a power button 330 disposed on the front section 312*b* of the handle frame 312, although the power button 330 may be located elsewhere, such as on the back section 312*c*, the stem 320, as part of the user interface 302, or elsewhere. The power button 330 is configured to be actuated by a user to turn the device 10 on and off.

The handle assembly 300 also includes an area rug button 340 disposed on a front exterior of the top section 312*d* of the handle frame 312, although the area rug button 340 may be located elsewhere, such as on the back section 312*c*, the stem 320, as part of the user interface 302, or elsewhere. The area rug button 340 is configured to be actuated by a user to activate an area rug mode when an area rug is to be cleaned using the cleaning device 10. In the area rug mode, some bleed air is provided to reduce air flow at the central intake.

In some embodiments, the power button 330 and/or the area rug button 340 can be omitted with the functionality of the omitted button(s) instead being provided via the user interface 302.

Figure 18:
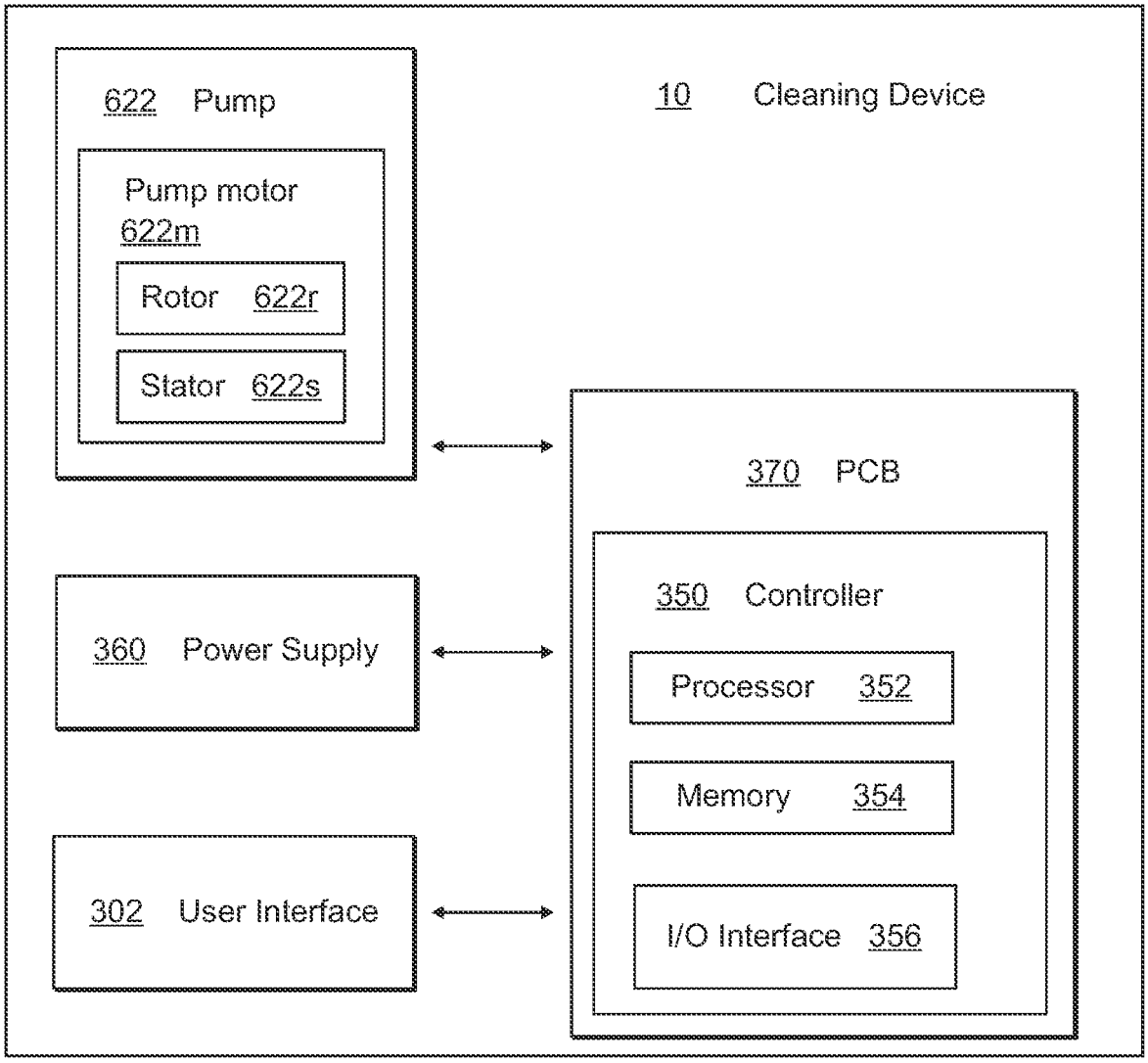
FIG. 18 is a schematic view of a portion of the cleaning device of FIG. 1.

The user interface 302, the power button 330, and the area rug button 340 are in operable communication with a controller 350, which is illustrated in FIG. 18. The user interface 302, the power button 330, and the area rug button 340 are configured to receive inputs from a user that cause the controller 350 to perform one or more operations responsive to the received inputs, as described further herein.

The controller 350 of the cleaning device 10 is configured to be in operable communication with various components of the cleaning device 10, including the user interface 302, the power button 330, the area rug button 340, the pump 622, and a power supply 360 (e.g., a battery or other source of power). As in this illustrated embodiment, the controller 350) can include a processor 352 and a memory 354 configured to store instructions which, when executed by the processor 352, cause the processor 352 to perform operations. The controller 350 in this illustrated embodiment also includes an input/output (I/O) interface 356 that enables the processor 350 to receive commands and/or data from other components of the cleaning device 10 for use in performing the operations. For example, the controller 350 can receive, through the I/O interface 356, data, e.g., a voltage value, from the fluid pump 622*m* characterizing an electromotive force (EMF) and provide that data to the processor 352 for use in performing operations requiring the received EMF data as an input, as described further herein. Similarly, the controller 350) can receive, from the user interface 302, the power button 330, and the area rug button 340) and via the I/O interface 68, data characterizing inputs received from the user by the user interface 302, the power button 330, and the area rug button 340) and provide that data to the processor 352 for use in performing operations that require the data received therefrom as input.

As shown in FIG. 18, the cleaning device 10 includes a printed circuit board (PCB) 370 including various components, which in this illustrated embodiment include the controller 350, configured to facilitate operation of the cleaning device 10. The PCB 370 can have a variety of configurations and, in some embodiments, the controller 350) can be included in the cleaning device 10 without use of a PCB.

Figure 16:
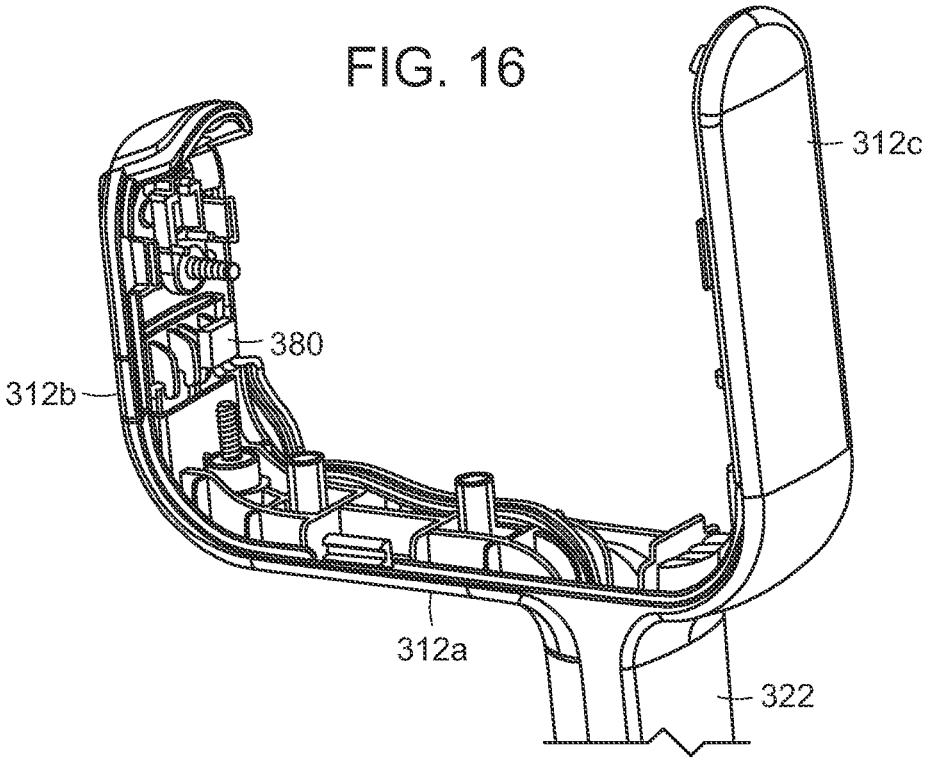
FIG. 16 is a perspective view of another partial portion of the handle assembly of FIG. 14.

The PCB 370 is located at a control unit 380 of the cleaning device 10. The control unit 380 is located at the handle assembly 300 in this illustrated embodiment, as shown in FIG. 16, but can be located elsewhere, such as at the head assembly 100 or the body assembly 200.

The cleaning device 10 also includes the power supply 360 that is configured to supply power to various components of the cleaning device 10 requiring power to operate. The power supply 360 is in operable communication with the controller 350. The power supply 360 is configured to receive commands from the controller 350, provided via the I/O interface 356, that cause the power supply 360 to provide electrical power to components as needed in reply to the power button 330 being actuated and to cease providing electrical power to components as needed in reply to the power button 330 being actuated again.

The fluid pump 622 is an electric pump that includes a pump motor 622*m* configured to provide a driving force that causes fluid to be drawn out of the fluid supply tank 600. In an exemplary embodiment, the motor 622*m* is a brushless direct current (BLDC) motor or other type of motor that includes a rotor 622*r* and a stator 622*s*. The rotor 622*r* is configured to rotate. The rotor 622*r* can include a permanent magnet, and the stator 622*s* can include metallic coils electrically coupled to a DC source 638 (see FIG. 19). DC current provided to the stator 622*s* from the DC source 638 is configured to create an electromagnetic field, which is configured to cause the rotor 622*r* to rotate such that the pump motor 622*m* can provide a rotational driving force configured to cause fluid to be drawn out of the fluid supply tank 600. The fluid pump 622 is operably coupled with the controller 350, as shown in FIG. 18, to facilitate fluid supply tank 600 empty detection based on the created EMF, as discussed further herein.

Figure 19:
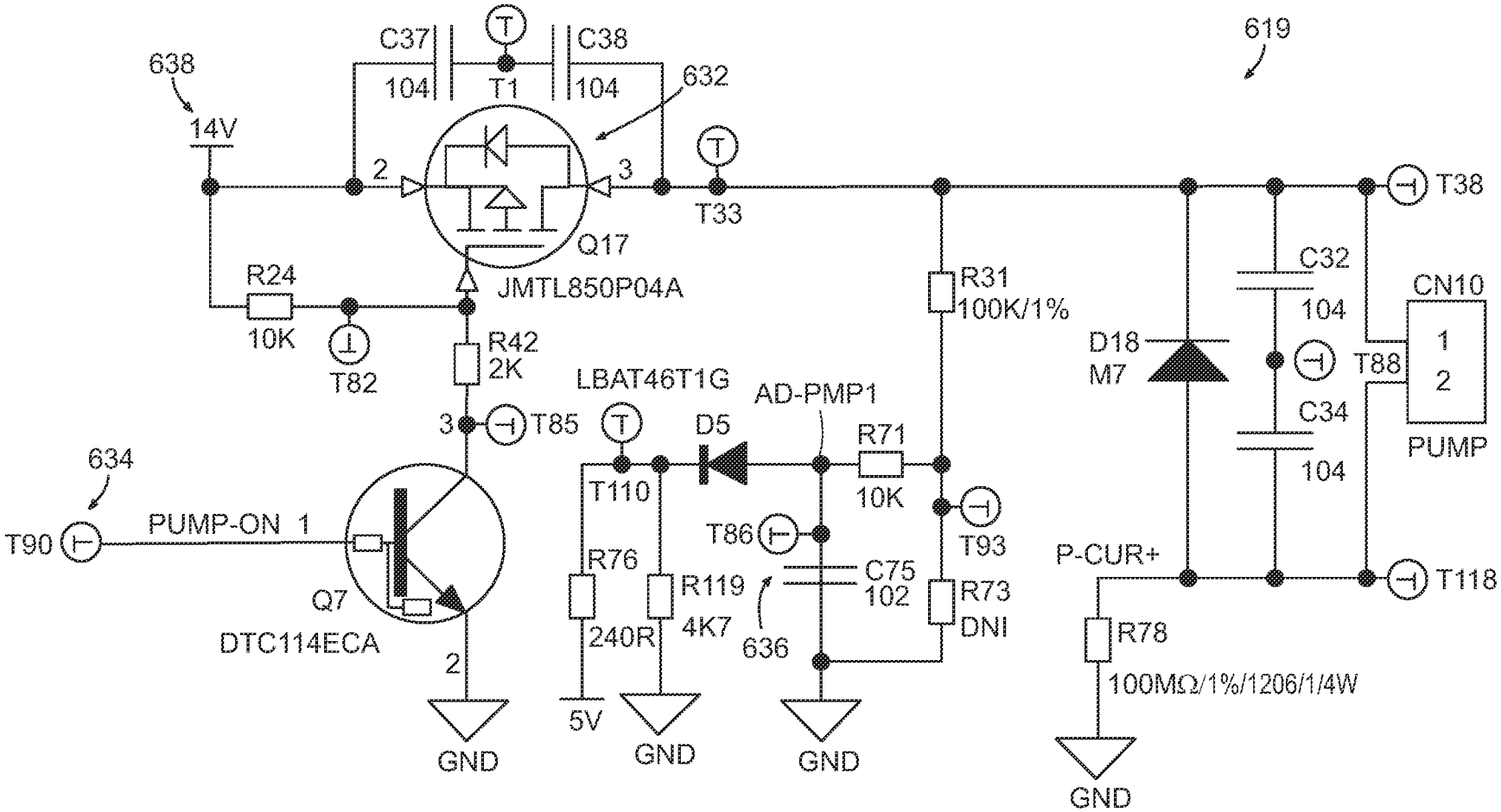
FIG. 19 is one embodiment of a circuit diagram for the cleaning device of FIG. 1.

One exemplary embodiment of a control circuit 619 including the fluid pump 622 is shown in FIG. 19 and includes a MOSFET 632, a first transistor 634, a second transistor 636, and the DC source 638. The DC source 638 is a 14 V source in this illustrated embodiment, although other voltage values are possible.

During a wet cleaning operation, the amount of fluid in the fluid supply tank 600 decreases because fluid is pumped out of the fluid supply tank 600. In the course of performing one or more wet cleaning operations, the fluid supply tank 600 will become substantially depleted of fluid and thus be substantially empty. A person skilled in the art will appreciate that a fluid supply tank may not be completely empty, e.g., because one or more droplets of fluid are stuck to an interior surface of the fluid supply tank, but nevertheless be considered to be substantially empty.

When the supply of fluid in the fluid supply tank 600 is determined to be empty, as discussed further herein, the cleaning device 10 is prevented from operating in a wet cleaning operation, e.g., by the controller 350) causing the pump 622 to stop pumping fluid (or not start if the pump 622 was not already pumping fluid). Additionally, the cleaning device 10 is configured to provide a user notification, e.g., the controller 350 is configured to cause the user notification to be provided via the user interface 302, that the fluid supply tank 600 must be refilled (or replaced) before a wet cleaning operation can begin, or, if a wet cleaning operation was in progress, can continue. The user notification can be visual and/or audible. The user notification can include, for example, a water droplet or other symbol being shown on a display of the user interface 302. The user notification can include, for example, text being shown on a display of the user interface 302. For another example, the user notification can include a light illuminating (solid illumination or blinking illumination) via the user interface 302. For yet another example, the user notification can include an audible one or more beeps or other sounds provided via the user interface 302.

In an exemplary embodiment, the controller 350 (e.g., the processor 352 thereof) is configured to determine whether the fluid supply tank 600 is empty using EMF data received from the pump 622. The EMF data is indicative of the EMF created by the pump motor 622*m* and, more particularly, the EMF generated by the motor as a rotating element of the motor 622*m*, e.g., the rotor 622*r* of the pump motor 622*m*, rotates while the pump 622 is running in a pulse width modulated duty cycle.

In response to the fluid pump 622 being turned on and receiving a control signal, e.g., a pulse width modulated (PWM) signal, from the first transistor 634, the MOSFET 632 receives DC current from the DC source 638. The pump motor's rotor 622*r* will therefore begin to rotate and an EMF will be created. The MOSFET 632 is generally acting as a generator. The controller 350) is configured to receive a signal from the fluid pump 622 indicative of the EMF. The EMF runs in the circuit 619 to the controller 350, and in particular to the second transistor 636 of the controller 350).

In response to the fluid pump 622 being turned off, the MOSFET 632 stops receiving DC current from the DC source 638 and the rotor 622*r* thus stops rotating. The rotor's rotation does not stop immediately when the fluid pump 622 is turned off. Instead, inertia causes the rotor 622*r* to continue rotating for a period of time after the fluid pump 622 has been turned off and stops receiving DC current. The EMF will continue being created during this period of time. The controller 350) (e.g., the second transistor 636 thereof) continues receiving the EMF signal for the period of time after the fluid pump 622 has been turned off.

The controller 350 (e.g., the processor 352 thereof) is configured to determine whether the fluid supply tank 600 is empty based on the received EMF signal. In general, if the EMF signal is less than a predetermined threshold EMF value, then the fluid supply tank 600 is determined to not be substantially empty, and if the EMF signal is greater than the predetermined threshold EMF value, then the fluid supply tank 600 is determined to be substantially empty. As discussed herein, in response to determining that the fluid supply tank 600 is substantially empty, the controller 350) (e.g., the processor 352 thereof) is configured to cause a user notification to be provided indicating that the fluid supply tank 600 must be refilled (or replaced).

With fluid present in the fluid supply tank 600, the fluid pump 622 runs with a load. Conversely, with the fluid supply tank 600 being substantially empty, the load is not present. The EMF created after the pump 622 has been turned off while the rotor 622*r* is still rotating due to inertia will therefore be higher when the fluid supply tank 600 is substantially empty than when the fluid supply tank 600 is not substantially empty.

Figure 20:
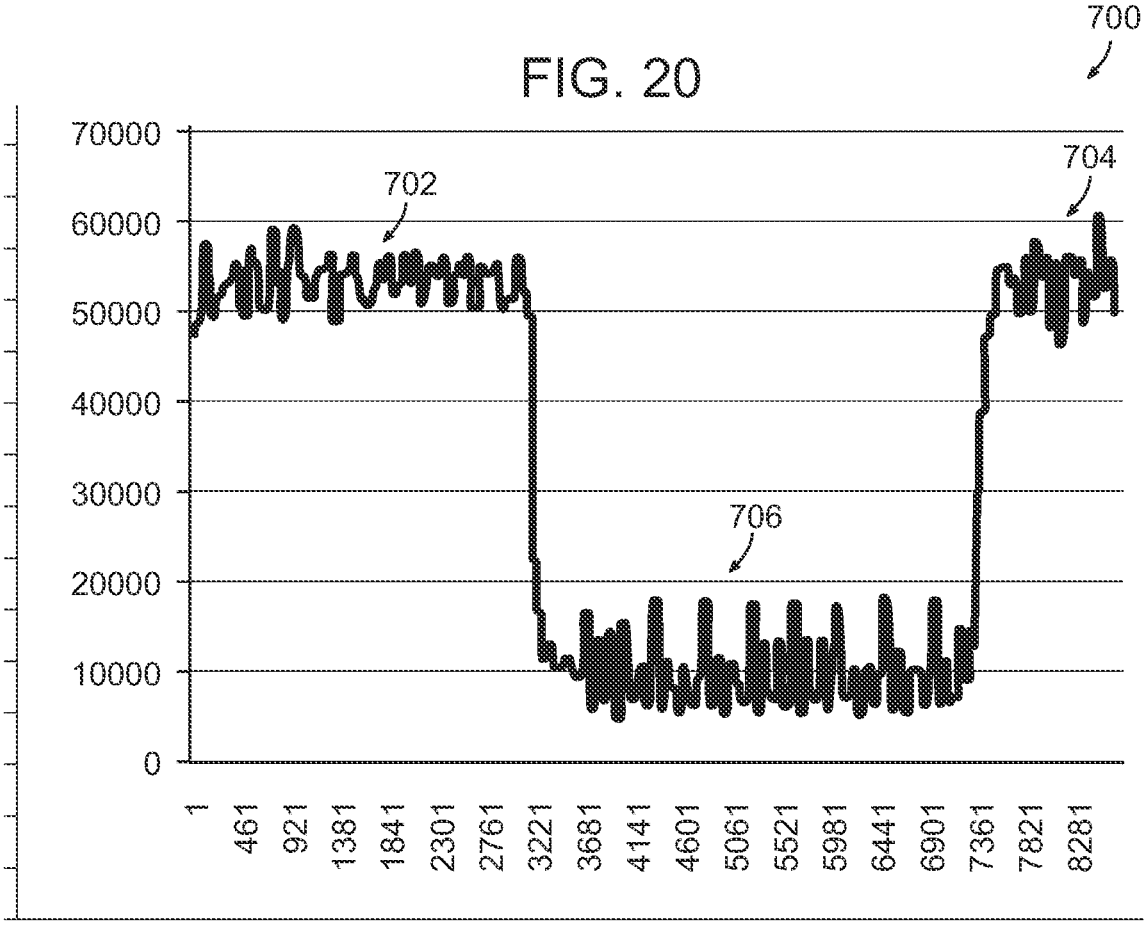
FIG. 20 is a graph showing EMF over time.

FIG. 20 illustrates a graph 700 showing one embodiment of EMF versus time. FIG. 20 shows two periods of time 702, 704 when a fluid supply tank (e.g., fluid supply tank 600 or other fluid supply tank) is substantially empty and another period of time 706 when the fluid supply tank is not substantially empty. As shown in FIG. 20, the EMF is higher when the fluid supply tank is substantially empty. The EMF can therefore be used by the controller 350 is determining whether the fluid supply tank 600 is substantially empty or not.

The predetermined threshold EMF value is preset. e.g., stored in the memory 354 of the controller 350, for a particular cleaning device 10. In an exemplary embodiment, the predetermined threshold EMF value is about halfway between an EMF value with the fluid supply tank 600 being substantially empty and an EMF value with the fluid supply tank 600 not being substantially empty. Being about halfway between these EMF values may help prevent false positives, e.g., prevent the controller 350 from determining that the fluid supply tank 600 is substantially empty when the fluid supply tank 600 still contains fluid therein that could be pumped out of the fluid supply tank 600 and delivered from the cleaning device 10 to a surface. Different cleaning devices can have different fluid supply tanks and/or different fluid pumps, so the predetermined threshold EMF value can vary for different cleaning devices. The predetermined threshold EMF value can thus be determined experimentally. In the example of FIG. 20, the predetermined threshold EMF value can be selected to be a voltage value of about 30,000, which is about halfway between an EMF value with the fluid supply tank 600 is substantially empty and an EMF value with the fluid supply tank 600 is not substantially empty.

The predetermined threshold value EMF is valid even if the cleaning device 10 is operating in different wet cleaning modes. In some embodiments, the cleaning device 10 is configured to operate in different wet cleaning modes, such as a bare floor wet cleaning mode, rug wet cleaning mode, and cleaning device self-cleaning mode. In different wet cleaning modes, the controller (e.g., the processor 352) thereof is configured to cause fluid to be pumped from the fluid supply tank 600 at different rates. For example, fluid can be pumped from the fluid supply tank 600 at a lower rate for cleaning bare floors than for cleaning a rug. For another example, fluid can be pumped from the fluid supply tank 600 at a higher rate for cleaning device 10 self-cleaning than for surface cleaning.

Figure 21:
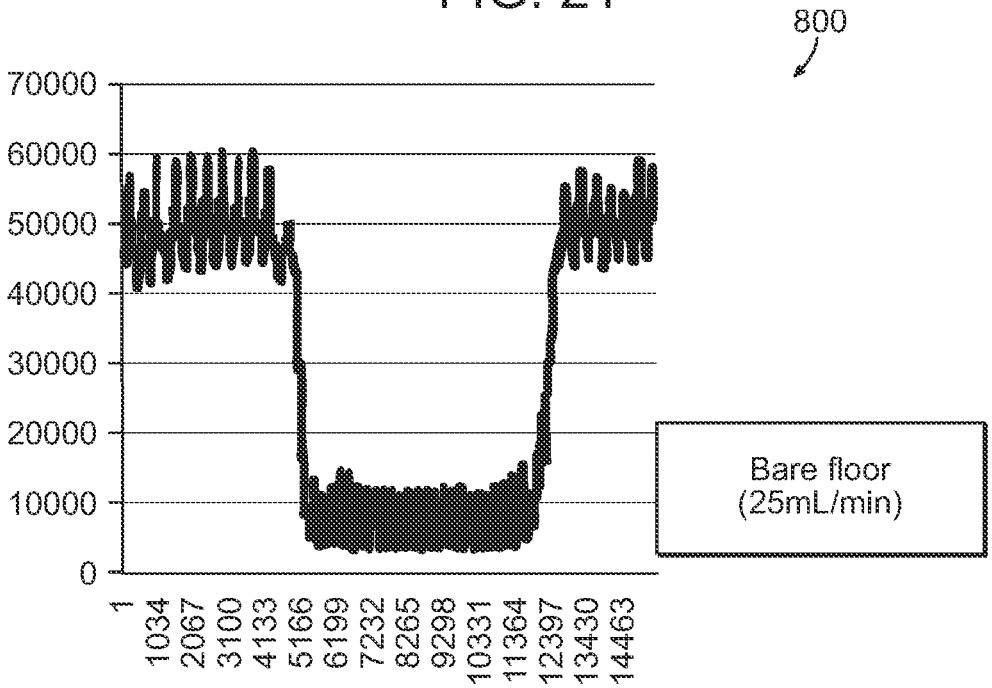
FIG. 21 is another graph showing EMF over time.
Figure 22:
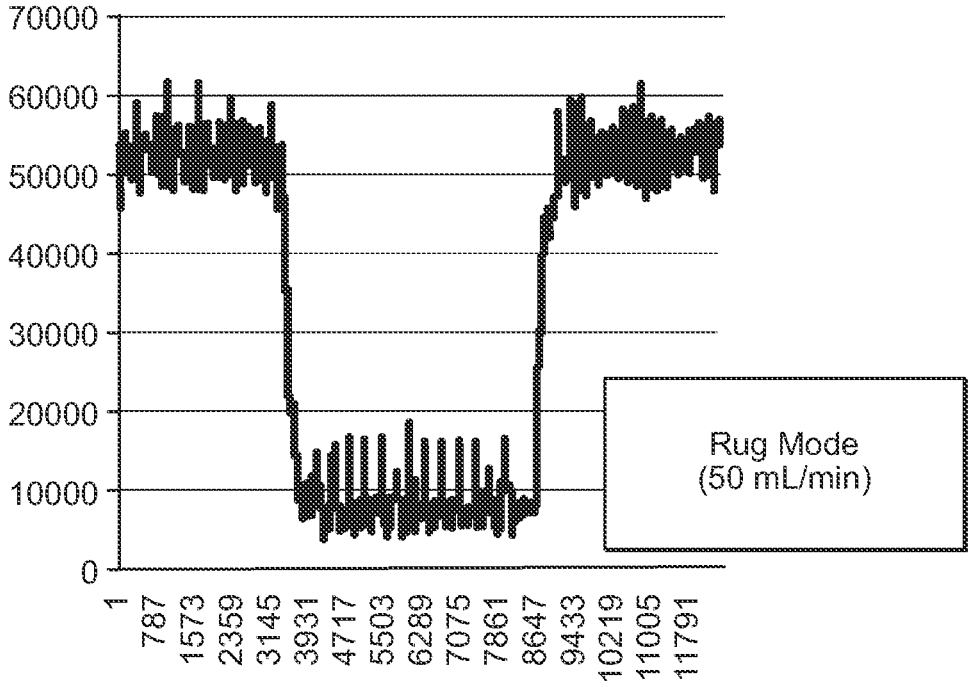
FIG. 22 is yet another graph showing EMF over time.
Figure 23:
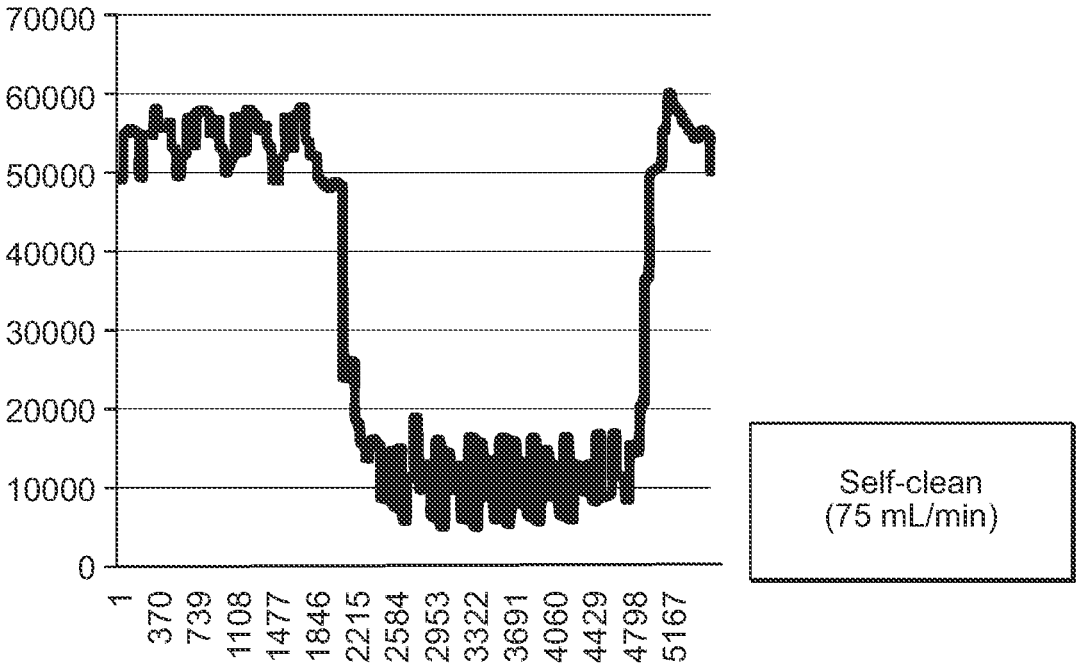
FIG. 23 is still another graph showing EMF over time.
Figure 24:
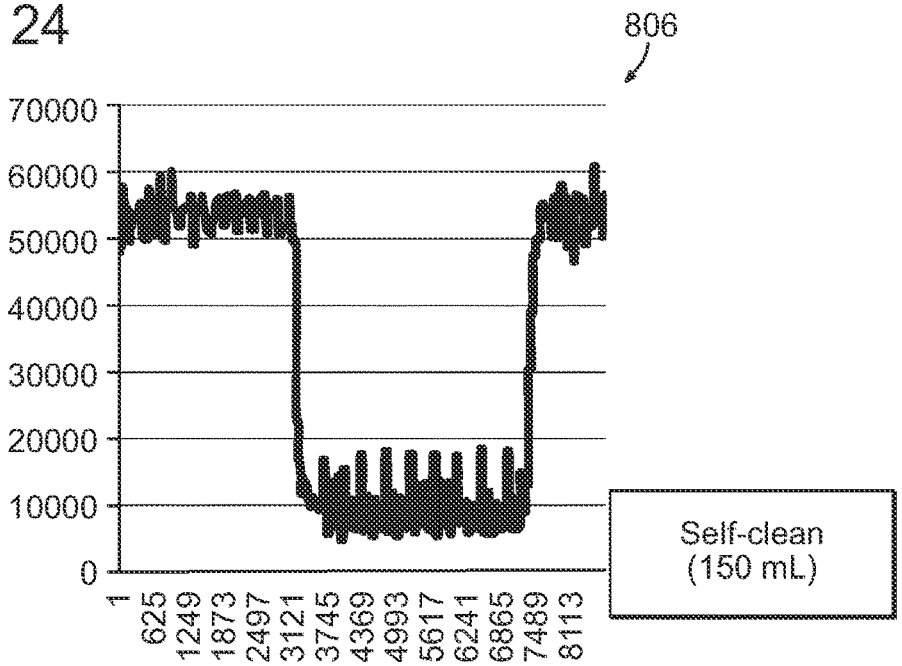
FIG. 24 is another graph showing EMF over time.

FIG. 21 illustrates a graph 800 showing one embodiment of EMF versus time for a bare floor wet cleaning mode. FIG. 22 illustrates a graph 802 showing one embodiment of EMF versus time for a rug wet cleaning mode. FIG. 23 illustrates a graph 804 showing one embodiment of EMF versus time for a first, low flow self-cleaning cleaning mode, and FIG. 24 illustrates a graph 806 showing one embodiment of EMF versus time for a second, high flow self-cleaning cleaning mode. As demonstrated by FIGS. 21-24, a predetermined threshold EMF value of about 30,000 is valid for all of the illustrated wet cleaning modes.

Figure 25:
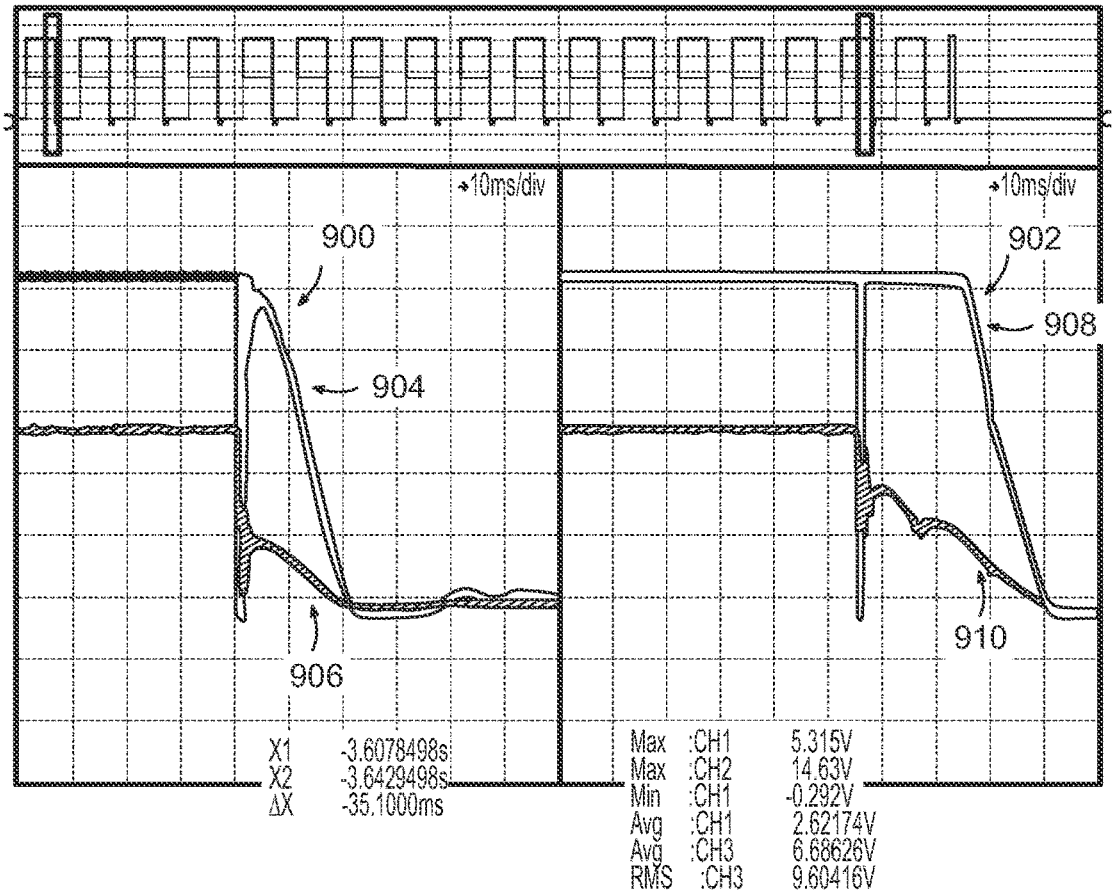
FIG. 25 are other graphs showing EMF over time.

FIG. 25 shows first and second graphs 900, 902 over time and illustrating EMF being higher when a fluid supply tank of a cleaning device (e.g., the cleaning device 10 or other cleaning device) is substantially empty as compared to when the fluid supply tank is not substantially empty. The first graph 900 shows a first line 904 representing power to a fluid pump of the cleaning device (e.g., the fluid pump 622 or other fluid supply tank) and a second line 906 representing an EMF created at the fluid pump, e.g., by rotation of a rotor of the fluid pump. The EMF begins to change when the power to the fluid pump stops and begins to decrease, as shown by the second line 906 sloping downward at a first slope after a first period of time has elapsed from the stop of power. The second graph 902 shows a third line 908 representing power to the fluid pump and a fourth line 910 representing an EMF created at the fluid pump. The EMF begins to change when the power to the fluid pump stops and begins to decrease, as shown by the fourth line 910 sloping downward at a second slope after a second period of time has elapsed from the stop of power.

As shown in FIG. 25, the first period of time is less than the second period of time, which reflects that the load experienced by the fluid pump is greater in the scenario shown in the first graph 900 than in the scenario shown in the second graph 902 because the fluid supply tank is not substantially empty in the scenario illustrated in the first graph 900 and is substantially empty in the scenario illustrated in the second graph 902. The first line 904 therefore begins sloping downward sooner in response to power stopping than the third line 908 begins sloping downward in response to power stopping because the fluid pump's rotor stops rotating sooner in the scenario illustrated in the first graph 900 than in the scenario illustrated in the second graph 902. Also, the first slope of the first line 904 is greater than the second slope of the third line 908, which also reflects that the load experienced by the fluid pump is greater in the scenario shown in the first graph 900 than in the scenario shown in the second graph 902.

Figure 26:
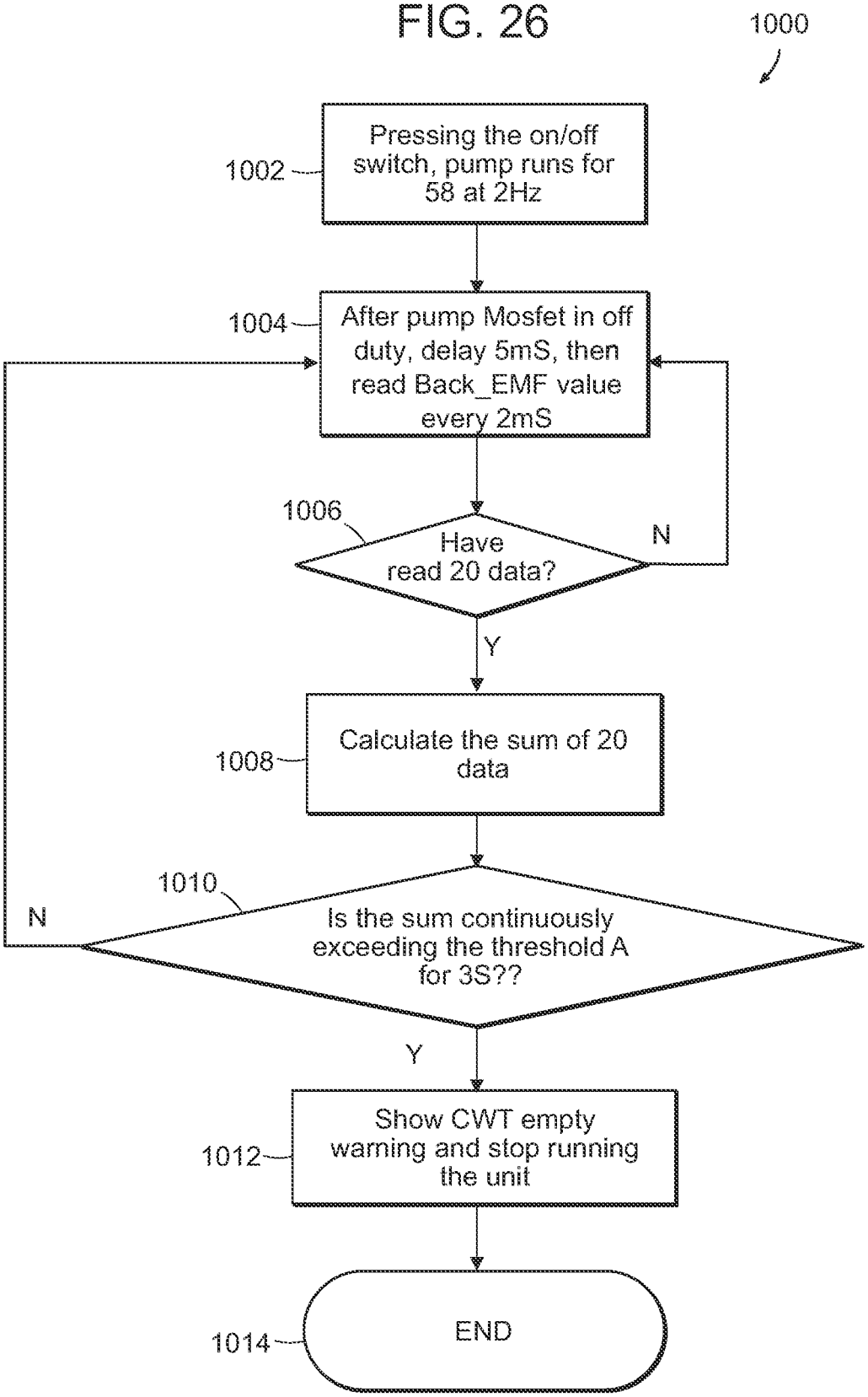
FIG. 26 is a flowchart of one embodiment of a method.

FIG. 26 illustrates one embodiment of a method 1000 of fluid tank empty detection. The method 1000 is described with respect to the cleaning device 10 of FIGS. 1-4 for ease of explanation but can be similarly performed with respect to another cleaning device or another type of device having a fluid supply tank configured to be refilled (or replaced).

The method 1000 includes the fluid pump 622 pumping 1002 fluid from the fluid supply tank 600. The pumping can start pumping 1002 by a user providing an input to the cleaning device 10, e.g., by the user pressing an on/off switch (as shown in FIG. 26) or by the user providing another input. The user's input is received by the controller 350 (e.g., the processor 352 thereof) and causes the controller 350 (e.g., the processor 352 thereof) to transmit a signal to the fluid pump 622 that causes the fluid pump 622 to start pumping and thereby start drawing fluid out of the fluid supply tank 600.

After running for a period of time during which fluid is drawn from the fluid supply tank 600, the fluid pump 622 stops 1004 pumping. The pump 622 is shown in FIG. 26 as pumping 1002 for five seconds with the pump 622 running at 5 Hz before stopping 1004, but another period of time of pumping 1002 and another frequency are possible. The pumping can stop 1004 pumping by a user providing an input to the cleaning device 10, e.g., by the user pressing an on/off switch or by the user providing another input. The user's input is received by the controller 350) (e.g., the processor 352 thereof) and causes the controller 350 (e.g., the processor 352 thereof) to transmit a signal to the fluid pump 622 that causes the fluid pump 622 to stop 1004 pumping and thereby stop drawing fluid out of the fluid supply tank 600.

The controller 350 (e.g., the processor 352 thereof) waits 1004 for a predetermined period of time delay after the pumping stops 1004 before the controller 350 (e.g., the processor 352 thereof) begins reading 1004 EMF data (identified as "Back_EMF value" in FIG. 26) from the fluid pump 622 on a regular periodic basis. The regular periodic basis is every 2 ms in FIG. 26 but other regular periodic bases are possible. The predetermined period of time delay is 5 ms in FIG. 26, but another predetermined period of time delay is possible. Waiting the predetermined period of time delay, e.g., as counted by a counter or timer of the controller 350) that is in operable communication with the processor 352, reflects noise at the pump 622 immediately after stopping 1004. The fluid pump 622 continues running for a period of time after stopping 1004 because the electric motor

622*m* of the fluid pump 622 cannot instantaneously stop completely, as discussed above. The first and third lines 904, 908 of the first and second graphs 900, 902, respectively, of FIG. 26 reflect noise in such a period of time before the first and third lines 904, 908 begin sloping downward.

After each read 1004 of the EMF data, the controller 350 (e.g., the processor 352 thereof) determines 1006 whether a predetermined number of EMF data reads 1004 have occurred, e.g., if a predetermined number of EMF data points have been acquired. The predetermined number of EMF data reads is twenty in FIG. 26, but other numbers are possible. If the predetermined number of EMF data reads 1004 has not occurred, then the controller 350) (e.g., the processor 352 thereof) continues reading 1004 EMF data.

If the predetermined number of EMF data reads 1004 has occurred, then the controller 350 (e.g., the processor 352 thereof) calculates 1008 a sum of the predetermined number of EMF data reads 1004, e.g., adds together the acquired EMF values. The calculation 1008 roughly calculates an area of the back electromotive force of the fluid pump 622. For example, with reference to the example of FIG. 25, the calculation 1008 for EMF data of the first graph 900 roughly calculates an area under the first line 904 and for EMF data of the second graph 902 roughly calculates an area under the third line 908.

Referring again to FIG. 26, the controller 350 (e.g., the processor 352 thereof) then determines 1010 whether the sum continuously exceeds the predetermined threshold EMF value (identified as "threshold A" in FIG. 26) for a predetermined amount of time. The predetermined amount of time is three seconds in FIG. 26, but another predetermined amount of time is possible. If the sum does not continuously exceed the predetermined threshold EMF value for the predetermined amount of time, the controller 350) (e.g., the processor 352 thereof) continues reading 1004 EMF data from the fluid pump 622 on the regular periodic basis. This reflects that the fluid supply tank 600 is not substantially empty and that fluid can therefore continue being pumped from the fluid supply tank 600.

If the sum does continuously exceed the predetermined threshold EMF value for the predetermined amount of time, the controller 350) (e.g., the processor 352 thereof), the fluid pump 622 stops 1012 running and a user notification is provided 1012 that the fluid supply tank 600 must be refilled (or replaced) before a wet cleaning operation can begin, or, if a wet cleaning operation was in progress, can continue. This reflects that the fluid supply tank 600 is substantially empty and that fluid cannot be pumped from the fluid supply tank 600 until the fluid supply tank 600 is refilled (or replaced). e.g., that the method 1000 has ended 1014 until the fluid supply tank 600 is refilled (or replaced) and pumping 1002 may begin again. The fluid pump 622 can stop 1012 running by the controller 350 (e.g., the processor 352 thereof) transmitting a signal to the fluid pump 622 that causes the pump 622 to stop pumping, e.g., for the motor 622*m* to stop running. The user notification can be provided 1012 in any number of ways, as discussed above.

Figure 27:
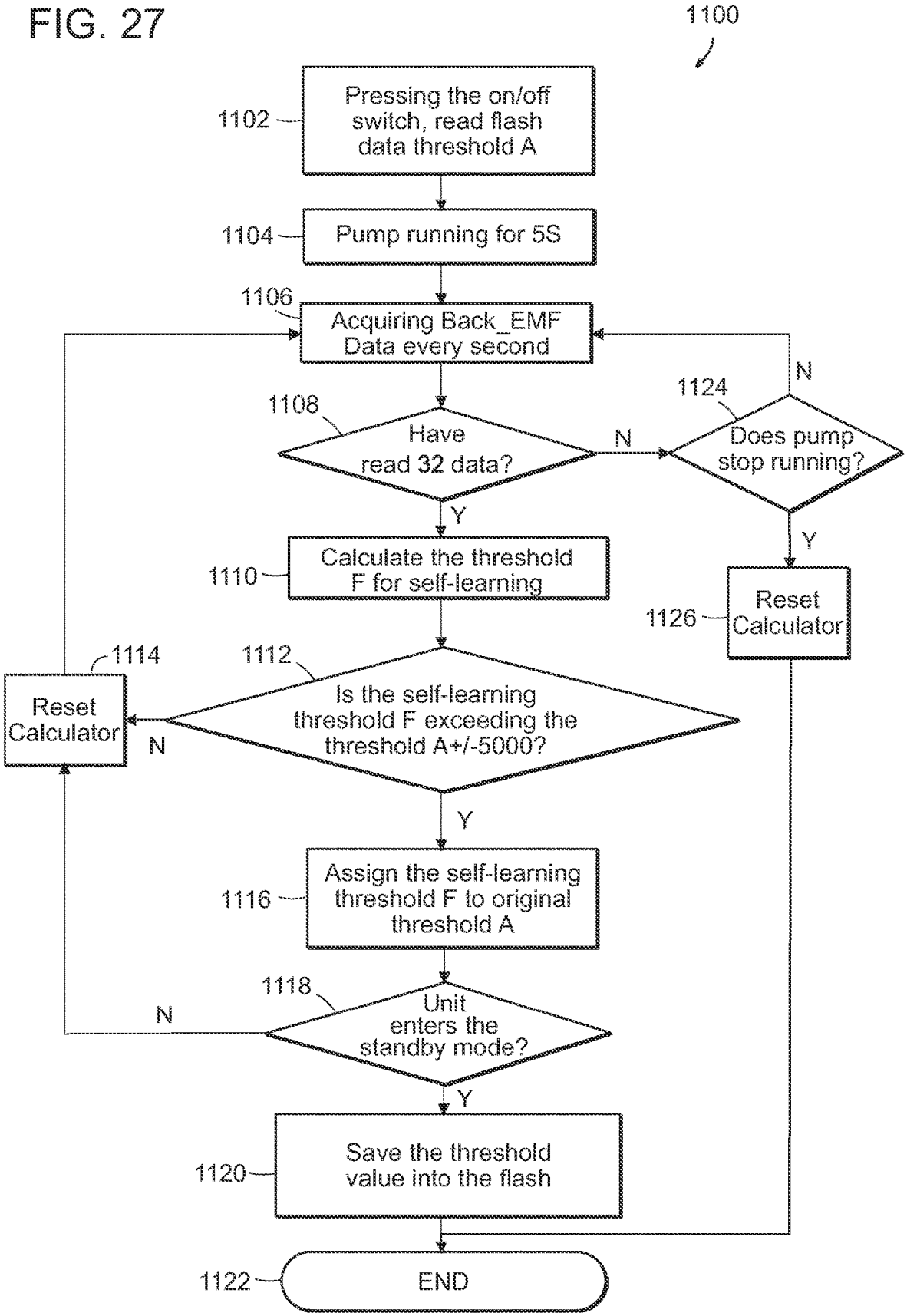
FIG. 27 is a flowchart of another embodiment of a method.

FIG. 27 illustrates another embodiment of a method 1100 of fluid tank empty detection. The method 1100 is described with respect to the cleaning device 10 of FIGS. 1-4 for ease of explanation but can be similarly performed with respect to another cleaning device or another type of device having a fluid supply tank configured to be refilled (or replaced).

In the method 1000 of FIG. 26, the predetermined threshold EMF value is preset and remains the same throughout performance of the method 1000. Conversely, in the method 1100 of FIG. 27, the predetermined threshold EMF value is initially at a preset value, but that value may change during performance of the method 1100. The method 1100 of FIG. 27 reflects that the cleaning device 10 can be configured to perform self-leaning or machine learning that results in the predetermined threshold EMF value being changed to another value. Self-learning or machine learning may allow for more accurate empty tank detection over time because electric motors experience wear and tear over time that can affect the created EMF. As discussed further below, the self-learning or machine learning is only conducted when the pump 622 is running and the EMF value is less than the threshold value which means that the fluid supply tank 600 is not empty.

The method 1100 includes the fluid pump 622 pumping 1102 fluid from the fluid supply tank 600. The pumping can start pumping 1102 by a user providing an input to the cleaning device 10, e.g., by the user pressing an on/off switch (as shown in FIG. 27) or by the user providing another input. The user's input is received by the controller 350 (e.g., the processor 352 thereof) and causes the controller 350 (e.g., the processor 352 thereof) to transmit a signal to the fluid pump 622 that causes the fluid pump 622 to start pumping and thereby start drawing fluid out of the fluid supply tank 600. The user's input being received by the controller 350 (e.g., the processor 352 thereof) also causes the controller 350 (e.g., the processor 352 thereof) to read 1102 the predetermined threshold EMF value (identified as "flash data threshold A" in FIG. 27) from the memory 354.

After running 1104 for a period of time during which fluid is drawn from the fluid supply tank 600, the controller 350 (e.g., the processor 352 thereof) begins reading 1106 EMF data (identified as "Back_EMF Data" in FIG. 27) from the fluid pump 622 on a regular periodic basis. The pump 622 is shown in FIG. 27 as running 1104 for five seconds, but another period of time of running 1104 is possible. The regular periodic basis is every 1 second in FIG. 27 but other regular periodic bases are possible. After each read 1106 of the EMF data, the controller 350) (e.g., the processor 352 thereof) determines 1108 whether a predetermined number of EMF data reads 1106 have occurred, e.g., if a predetermined number of EMF data points have been acquired. The predetermined number of EMF data reads is thirty-two in FIG. 27, but other numbers are possible.

If the predetermined number of EMF data reads 1106 has occurred, then the controller 350 (e.g., the processor 352 thereof) calculates 1110 a potential new predetermined threshold EMF value (identified as "threshold F for self-learning" in FIG. 27). The potential new predetermined threshold EMF value is calculated 1110 by averaging the read 1106 EMF data and adding a predetermined value. For example, for an initial predetermined threshold EMF value of 30,000 (as discussed above) the predetermined value added to the average EMF can be 20,000. The potential new predetermined threshold EMF value can be calculated 1110 by the controller 350 (e.g., the processor 352 thereof) only when the fluid supply tank 600 had at least some fluid therein that the pump 622 pumped from the fluid supply tank 600. Otherwise, no EMF data could have been acquired 1106 for performance of the calculation 1110.

After calculating 1110 the potential new predetermined threshold EMF value, the controller 350 (e.g., the processor 352 thereof) determines 1112 whether the potential new predetermined threshold EMF value is within a predetermined range of the predetermined threshold EMF value. The predetermined range is +/−5,000 in FIG. 27, but another predetermined range is possible. If potential new predetermined threshold EMF value is within the predetermined range of the predetermined threshold EMF value, the controller 350 (e.g., the processor 352 thereof) resets 1114 the calculator (e.g., the controller 350 (e.g., the processor 352 thereof) that calculated 1110 the potential new predetermined threshold EMF value resets) and continues reading 1106 EMF data from the fluid pump 622 on the regular periodic basis. This reflects that the predetermined threshold EMF value remains the same.

If the potential new predetermined threshold EMF value is not within the predetermined range of the predetermined threshold EMF value, the potential new predetermined threshold EMF value is assigned 1116 as the predetermined threshold EMF value. Such assigning 1116 can be performed by the controller 350 (e.g., the processor 352 thereof) causing the potential new predetermined threshold EMF value to be stored as the predetermined threshold EMF value in volatile memory of the memory 624.

After setting 1116 the new predetermined threshold EMF value, the controller 350 (e.g., the processor 352 thereof) determines 1118 whether the fluid pump 622 has not stopped running, which is shown in FIG. 27 as the cleaning device 10 entering a standby mode. If the fluid pump 622 has stopped running, then the controller 350 (e.g., the processor 352 thereof) continues reading 1106 EMF data.

If the fluid pump 622 has stopped running 1004, then the controller 350 (e.g., the processor 352 thereof) saves 1120 the potential new predetermined threshold EMF value as the predetermined threshold EMF value. Such saving 1120 can be performed by the controller 350 (e.g., the processor 352 thereof) causing the potential new predetermined threshold EMF value to overwrite the predetermined threshold EMF value in non-volatile memory (shown in FIG. 27 as "flash" memory) of the memory 624. The method 1100 then ends 1122 until the pumping begins again.

If the predetermined number of EMF data reads 1106 has not occurred, then the controller 350 (e.g., the processor 352 thereof) determines 1124 whether the pump 622 has stopped running. If not, then the controller 350 (e.g., the processor 352 thereof) continues reading 1106 EMF data. If so, then the controller 350) (e.g., the processor 352 thereof) resets 1126 the calculator, similar to the resetting 1114 discussed above, and the method ends 1122 as discussed above.

The methods 1000, 1100 of FIGS. 26 and 27 can each be implemented in the cleaning device 10 such that the device 10 is configured to perform self-learning. Alternatively, only the method 1000 of FIG. 26 can be implemented in the cleaning device 10 such that the device 10 is not configured to perform self-learning.

The subject matter described herein can be implemented in analog electronic circuitry, digital electronic circuitry, and/or in computer software, firmware, or hardware, including the structural means disclosed in this specification and structural equivalents thereof or in combinations of them. The subject matter described herein can be implemented as one or more computer program products, such as one or more computer programs tangibly embodied in an information carrier (e.g., in a machine-readable storage device), or embodied in a propagated signal, for execution by, or to control the operation of, data processing apparatus (e.g., a programmable processor, a computer, or multiple computers). A computer program (also known as a program, algorithm, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub-programs, or portions of code).

The processes and logic flows described in this specification, including the method steps of the subject matter described herein, can be performed by one or more programmable processors executing one or more computer programs to perform functions of the subject matter described herein by operating on input data and generating output. The processes and logic flows can also be performed by, and apparatus of the subject matter described herein can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processor of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, (e.g., EPROM, EEPROM, and flash memory devices). The processor and the memory can be supplemented by, or incorporated in, special purpose logic circuitry.

The techniques described herein can be implemented using one or more modules. As used herein, the term "module" refers to computing software, firmware, hardware, and/or various combinations thereof. At a minimum, however, modules are not to be interpreted as software that is not implemented on hardware, firmware, or recorded on a non-transitory processor-readable recordable storage medium (i.e., modules are not software per se). Indeed "module" is to be interpreted to always include at least some physical, non-transitory hardware such as a part of a processor or computer. Two different modules can share the same physical hardware (e.g., two different modules can use the same processor). The modules described herein can be combined, integrated, separated, and/or duplicated to support various applications. Also, a function described herein as being performed at a particular module can be performed at one or more other modules and/or by one or more other devices instead of or in addition to the function performed at the particular module.

One skilled in the art will appreciate further features and advantages of the devices, systems, and methods based on the above-described embodiments. Accordingly, this disclosure is not to be limited by what has been particularly shown and described, except as indicated by the appended claims. All publications and references cited herein are expressly incorporated herein by reference in their entirety for all purposes.

The present disclosure has been described above by way of example only within the context of the overall disclosure provided herein. It will be appreciated that modifications within the spirit and scope of the claims may be made without departing from the overall scope of the present disclosure.

What is claimed is:

1. A system comprising:

a fluid pump of a cleaning device configured to pump a fluid from a fluid supply tank for delivery to a surface to be cleaned by the cleaning device, the fluid pump including a motor configured to drive the pumping of the fluid and to generate an electromotive force (EMF); and a controller configured to receive from the fluid pump a signal indicative of the EMF and configured to determine, based on the received signal, whether the fluid supply tank is substantially empty;

wherein determining the fluid supply tank is substantially empty includes comparing EMF data from after the fluid pump has been turned off with a pre determined threshold EMF value.

2. The system of claim 1, wherein the controller is configured to, in response to determining that the fluid supply tank is substantially empty, cause a user notification to be provided via the cleaning device indicating that the fluid supply tank is substantially empty.

3. The system of claim 1, wherein the controller receiving the signal includes the controller receiving a plurality of signals from the fluid pump, each of the plurality of signals being indicative of the EMF generated by the motor during a period of time; and the controller determining whether the fluid supply tank is substantially empty includes the controller comparing the plurality of signals with the predetermined threshold EMF value.

4. The system of claim 3, wherein the predetermined threshold EMF value is a preset value that does not change.

5. The system of claim 1, further comprising the fluid supply tank.

6. The system of claim 1, wherein the motor includes a rotor and a stator.

7. The system of claim 1, further comprising a user interface configured to receive a user instruction that causes the fluid pump to be turned off.

8. The system of claim 3, wherein the controller is configured to determine whether the plurality of signals are outside of a predetermined range;

if the plurality of signals are not outside of the predetermined range, the predetermined threshold EMF value remains the same; and if the plurality of signals are outside of the predetermined range, the controller is configured to change the predetermined threshold EMF value to a new predetermined threshold EMF value.

9. The system of claim 8, wherein the controller is configured to calculate the new predetermined threshold EMF value based on the plurality of signals.

10. A system, comprising:

a fluid pump of a cleaning device configured to pump a fluid from a fluid supply tank for delivery to a surface to be cleaned by the cleaning device, the fluid pump including a motor configured to drive the pumping of the fluid and to generate an electromotive force (EMF); and a controller configured to receive from the fluid pump a signal indicative of the EMF and configured to determine, based on the received signal, whether the fluid supply tank is substantially empty;

wherein the controller receiving the signal includes the controller receiving a plurality of signals from the fluid pump, each of the plurality of signals being indicative of the EMF generated by the motor during a period of time; and the controller determining whether the fluid supply tank is substantially empty includes the controller comparing the plurality of signals with a predetermined threshold EMF value; and the controller is configured to determine whether the plurality of signals are outside of a predetermined range;

if the plurality of signals are not outside of the predetermined range, the predetermined threshold EMF value remains the same; and if the plurality of signals are outside of the predetermined range, the controller is configured to change the predetermined threshold EMF value to a new predetermined threshold EMF value.

11. The system of claim 10, wherein the controller is configured to calculate the new predetermined threshold EMF value based on the plurality of signals.

12. A system comprising:

a processor; and a memory storing instructions that, when executed by the processor, cause the processor to perform operations comprising:

causing a fluid pump of a cleaning device to pump a fluid from a fluid supply tank for delivery to a surface to be cleaned by the cleaning device, the fluid pump including a motor configured to drive the pumping of the fluid and to generate an electromotive force (EMF), and determining, based on the EMF generated after the fluid pump has been turned off, whether the fluid supply tank is substantially empty.

13. The system of claim 12, wherein the operations further comprise, in response to determining that the fluid supply tank is substantially empty, causing a user notification to be provided via the cleaning device indicating that the fluid supply tank is substantially empty.

14. The system of claim 12, wherein determining whether the fluid supply tank is substantially empty includes comparing EMF data received by the processor from the fluid pump with a predetermined threshold EMF value.

15. The system of claim 14, wherein the predetermined threshold EMF value is a preset value that does not change.

16. The system of claim 14, wherein the operations further comprise determining whether the EMF data are outside of a predetermined range;

if the EMF data is not outside of the predetermined range, the predetermined threshold EMF value remains the same; and if the EMF data is outside of the predetermined range, the operations further comprise changing the predetermined threshold EMF value to a new predetermined threshold EMF value.

17. The system of claim 16, wherein the operations further comprise calculating the new predetermined threshold EMF value based on the EMF data.

18. The system of claim 12, further comprising the fluid supply tank.

19. The system of claim 12, wherein the operations further comprise causing the fluid pump to be turned off in response to a user input to the cleaning device.

* * * * *